US006565388B1

(12) United States Patent
Van Woensel et al.

(10) Patent No.: US 6,565,388 B1
(45) Date of Patent: May 20, 2003

(54) SHIELDED CABLE CONNECTOR

(75) Inventors: Johannes M. B. Van Woensel, Rosmalen (NL); James R. Volstorf, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/194,891

(22) PCT Filed: Jun. 5, 1997

(86) PCT No.: PCT/US97/10063

§ 371 (c)(1),
(2), (4) Date: Dec. 22, 2000

(87) PCT Pub. No.: WO97/47058

PCT Pub. Date: Dec. 11, 1997

Related U.S. Application Data

(60) Provisional application No. 60/019,168, filed on Jun. 5, 1996.

(51) Int. Cl.[7] ..... H01R 9/03

(52) U.S. Cl. ..... 439/610; 439/357

(58) Field of Search ..... 439/610, 607, 439/608, 357, 358, 906

(56) References Cited

U.S. PATENT DOCUMENTS

| | | | | | |
|---|---|---|---|---|---|
| 4,824,383 | A | * | 4/1989 | Lemke | 439/108 |
| 5,154,629 | A | * | 10/1992 | Carver et al. | 439/352 |
| 5,171,161 | A | * | 12/1992 | Kachlic | 439/352 |
| 5,277,624 | A | * | 1/1994 | Champion et al. | 439/607 |
| 5,417,590 | A | * | 5/1995 | Dechelette et al. | 439/607 |
| 5,456,618 | A | * | 10/1995 | Nakamura | 439/610 |
| 5,522,731 | A | * | 6/1996 | Clark et al. | 439/108 |

* cited by examiner

*Primary Examiner*—Tulsidas Patel
(74) *Attorney, Agent, or Firm*—Steven M. Reiss; M. Richard Page

(57) ABSTRACT

A shielded cable connector (20) which minimizes EMI and crosstalk between closely situated assembly modules is disclosed. The shielded cable connector comprises a connecting latch (28). The shielded cable connector facilitates insertion of the shielding housing (20) into a shielded header connector (24), and prevents inadvertent removal of the shielding housing (20) from the shielded header (24).

22 Claims, 26 Drawing Sheets

SHIELDED CABLE CONNECTOR

This application claims the benefit of Provisional Application No. 60/019,168, filed Jun. 5, 1996.

FIELD OF THE INVENTION

The present invention relates generally to cable connectors. In particular, the invention relates to a shielded cable connector for reducing electromagnetic interference (EMI) and crosstalk between and among closely situated cable connections.

BACKGROUND OF THE INVENTION

High density back panel connectors such as METRAL™ connectors, sold by Berg Electronics, are available in various standardized lengths. Such high density connectors have a standardized contact grid pitch of 2 mm and standardized mating interface dimensions. Such connectors have been marketed widely by several companies and are widely known in the industry.

It is generally known in the art, that such connectors are modularized and can be combined and assembled to form connectors having a particular desirable length. Typically, this is accomplished by stacking standard length headers and receptacle connector modules. To form both sides of an electrical interconnection, for example, an assembly module, or cable terminator matching the desired length can be plugged into an assembly of stacked header connectors.

Although stacking such connectors is known in the art, problems remain with regard to combining connectors in this manner. Because the close proximity of the modules and the close spacing of contacts, these systems are susceptible to crosstalk. The connectors may encounter EMI from external sources as well as from each other. Also, inserting a mating module into a series or stack of header connectors is often difficult. Such modular arrangements have in the past provided insufficient guidance mechanisms so as to insure proper connection between mating arrays of modules. Further, assembly modules such as those forming cable connectors often are inadvertently disconnected from the header connector. Thus, prior art connectors lack a reliable means for preventing movement of cable connectors once they are engaged with the composite header.

Therefore, there remains a need for a cable connector which minimizes EMI and crosstalk, provides sufficient guidance so as to easily attach an assembly module to a header connector, and provides a means of adequately securing an assembly module to a header connector.

SUMMARY OF THE INVENTION

The present invention, fulfills this need with a shielded high density cable interconnection system. The present inventive shielded interconnection system comprises an assembly module, a header connector adapted for accepting the assembly module, a shielding housing for enveloping the assembly module, and a latch member for securing the shielding housing and the assembly module to the header connector.

The shielded interconnection system comprises a shielded header having a first sidewall, a second sidewall, and a rear header wall having multiple terminals extending therefrom for receiving the assembly module. The first sidewall and the second sidewall have receiving slots for guiding the shielding housing into the shielded header connector. The first sidewall and second sidewall each further have grounding springs which contact dimple recesses located on the shielding housing when the shielding housing is inserted into the header connector. The second sidewall also has a recess located therein for accepting the latch member.

The shielding housing of the cable connector comprises a first half shell and a second half shell. The shielding housing further comprises a means for attaching the first half shell with the second half shell so as to form a 360 degree shielding around the perimeter of said assembly module.

The latch member of the interconnection system comprises an elongated distal object having at least one first leg end for insertion into the shielded header connector, and a second spring arm end for latching onto the shielding housing. The latch member functions to immobilize the relative movement of the shielded header and the shielding housing and thereby prevent inadvertent disconnection of the cable connector from the shielded header connector.

Other features of the present invention are described below.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION OF THE INVENTION

Figure 1A:
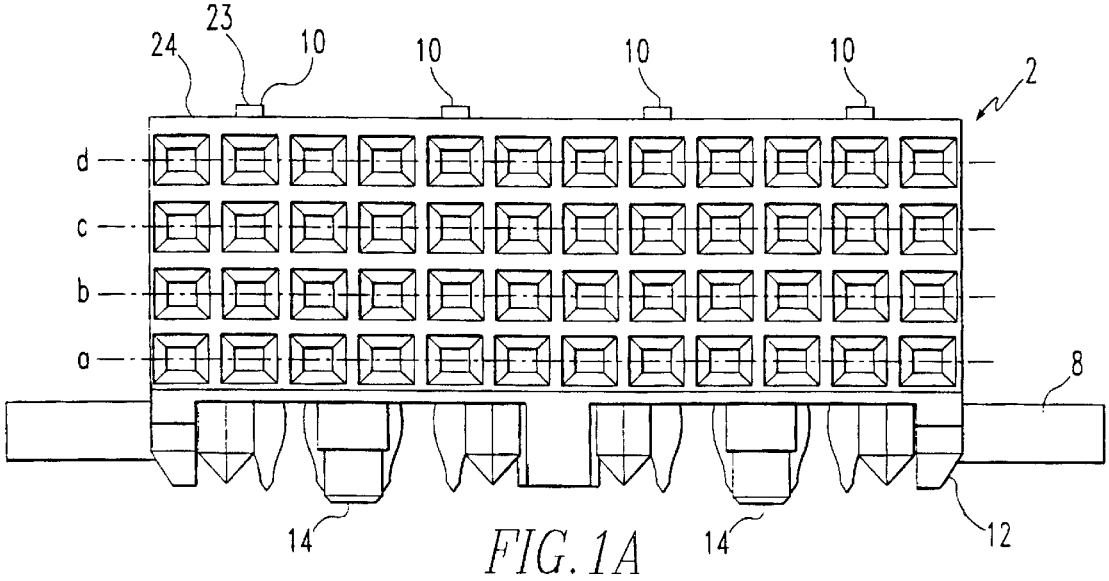
FIG. 1A PRIOR ART
FIGS. 1A through 1D depict a prior art METRAL™ receptacle connector and header connector.

FIGS. 1A through 1E depict a prior art receptacle connector and header connector such as the METRAL™ line of connectors sold by Berg Electronics. As shown in FIG. 1A, a receptacle connector 2 includes a matrix of contact terminals 4 mounted within a housing area electrically connected to tails 6. The distance between the center of any two adjacent rows (e.g. row a and b) of terminals 4 is 2 mm. Similarly, the distance between the center of any two adjacent columns (e.g. 23 and 24) of terminals is 2 mm. Thus, the basic connection grid for a prior art METRAL™ receptacle is 2×2 mm. Prior art METRAL™ receptacle connectors 2 typically come in modules having six columns and are therefore 12 mm in length. Although the receptacle 2 shown in FIG. 1A has four rows of terminals 4, it will be understood that the number of terminal 4 rows may vary. Generally, the basic receptacle connector module contains 5 rows and 6 columns and is referred to as a 5×6 receptacle module. The present invention is described below with reference to FIGS. 2 through 19, all of which assume a 5×6 receptacle connector. It should be noted that the receptacle connector 2 shown in FIG. 1 is a portion of a composition of several receptacle connector modules which are shown stacked together, end to end.

Figure 1B:
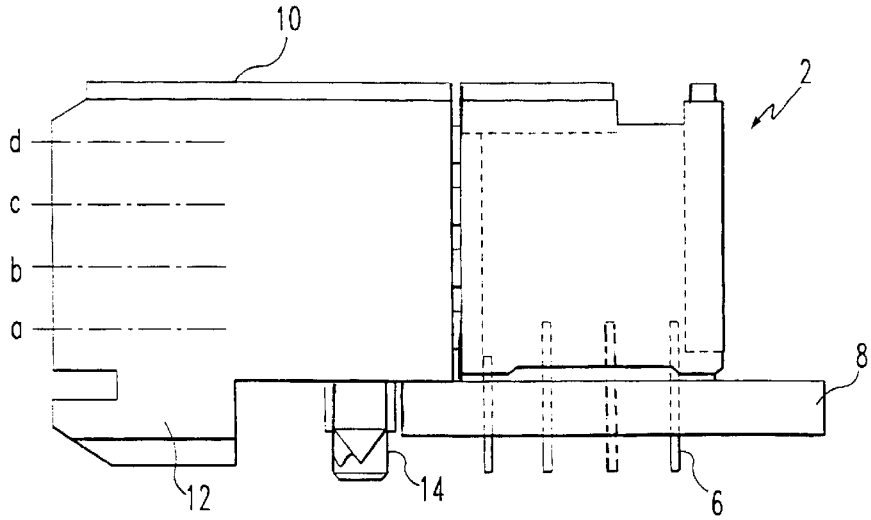
FIG. 1B PRIOR ART

FIG. 1B provides a side view of a prior art METRAL™ receptacle connector 2. Prior art METRAL™ receptacle connector 2 is characterized by dual beam contact terminals attached to right angle bent tails 6, which are thru-mount or press-fit to a printed circuit board 8.

Figure 1C:
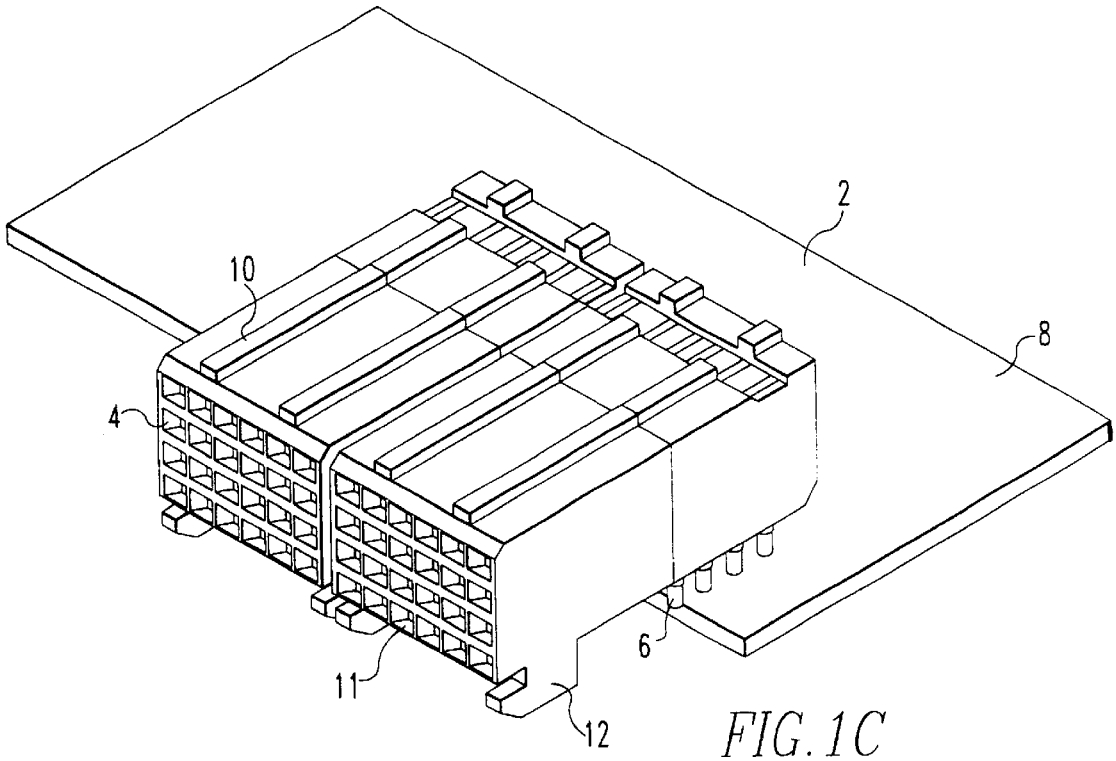
FIG. 1C PRIOR ART

FIG. 1C provides an elevated perspective view of a prior art METRAL™ receptacle connector 2. As shown in FIG. 1C, a receptacle connector 2 has two raised rails 10 on one side with two polarizing latch ears 12 and fixing pegs 14 (FIG. 1B) on the opposite side.

Figure 1D:
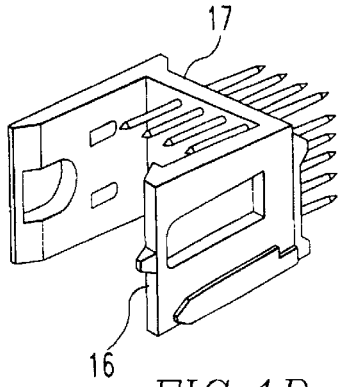
FIG. 1D PRIOR ART

FIG. 1D is a view of a prior art straight through header connector 16. In one contemplated form of the invention pins extending from the rear 17 of the header connector 16 are received by the terminals 4 of receptacle connectors 2, to convert the receptacles 2 for receipt of receptacle type cable connectors, later described. Similar to the receptacle connector 2, header connector modules typically are 5×6 in dimension so as to cooperate with the receptacle connectors 2 of similar dimension. Alternatively, a right angle pin header, preferably shielded, can be used in place of the combination of receptacle 2 and straight-through header 16.

Figure 2:
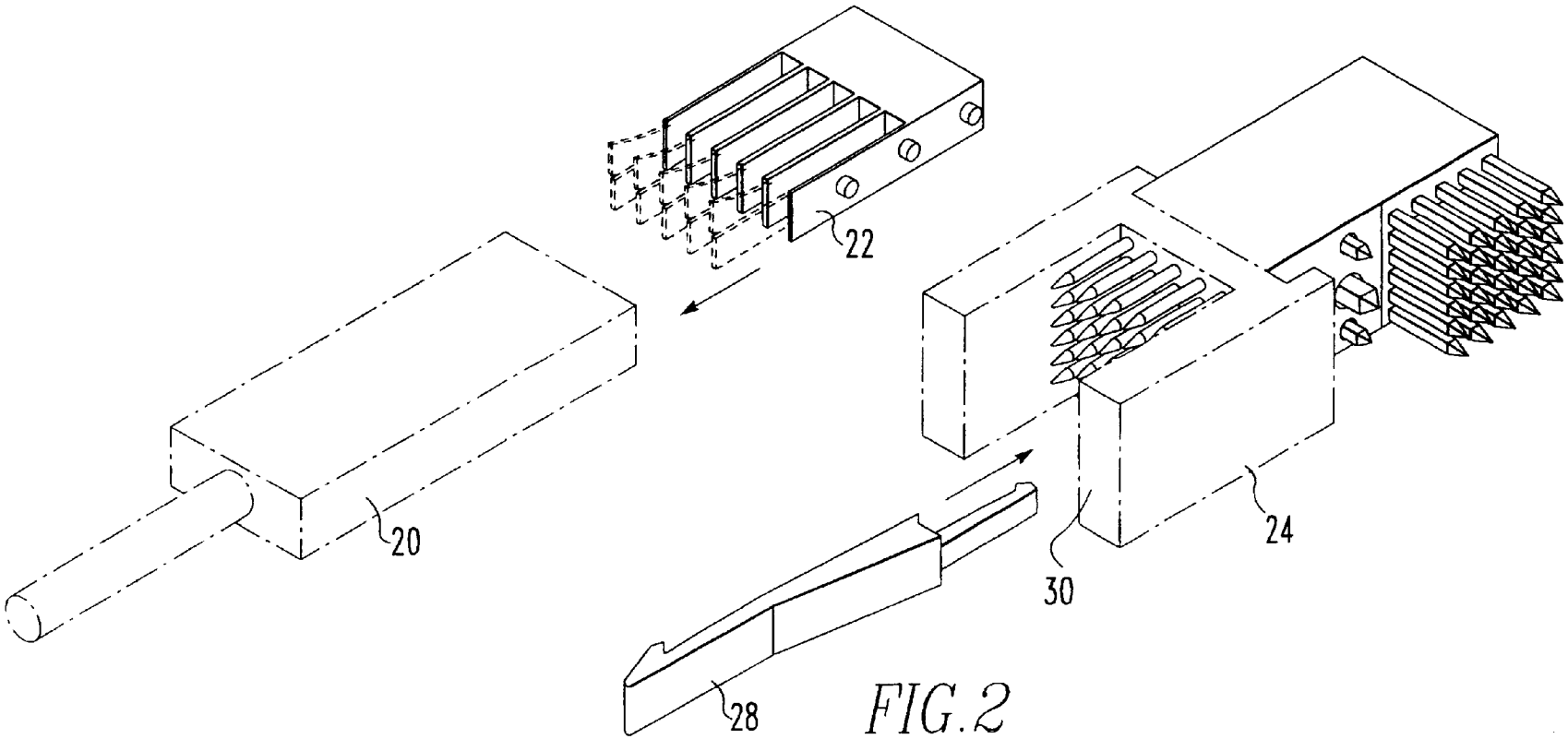
FIG. 2 provides a perspective view of the basic component parts of the present invention.

FIG. 2 provides a simplified perspective view of the present invention. As shown in FIG. 2, a shielding housing 20 envelopes an assembly module 22 which is subsequently attached to a shielded or die cast header 24 to provide a modular shielded-interconnection.

The shielding housing 20 is made from an alloy which is environmentally acceptable and which provides sufficient insulating qualities so as to prevent EMI and crosstalk. In the presently preferred embodiment, the shielding housing 20 is made from a beryllium copper alloy with a thickness of about 0.15 mm. Other suitable materials could alternatively used.

Also shown is a connecting latch 28. A connecting latch 28 attaches to the wall 30 of the shielded header 24 and latches onto the shielding housing 20. The connecting cable latch 28 operates to secure the shielding housing 20 and enveloped assembly module 22 to the shielded header 24.

Although not visible in FIG. 2, the basic assembly module 22 may contain, for example, two rows of terminals with each row containing five terminals. Typically, the terminals include a front receptacle contact portion for mating with the pins of header 24 and rear portions to which individual wires from a cable are attached, for example, by an IDC termination. As suggested by the Figure, when an assembly module 22 is plugged into the header connector 24, the assembly module attaches to the header so as to be ninety degrees rotated from the receptacle connector. Therefore the columns of assembly terminals 26 are connected indirectly through the header 24 to the rows of terminals in the receptacle connector 2. Similarly, the rows of terminals 26 in the assembly module 22 are indirectly connected to the columns of terminals 4 in the receptacle connector 2. In relation to the matrix terminals 4 of the receptacle connector 2, the assembly module 22 is said to be a 5×2 module, where 5 represents the number of rows in the receptacle connector 2 to which the assembly module 22 is connected and 2 represents the number of columns in the receptacle connector 2 to which the assembly module 22 is connected. As noted above, each terminal 4 column in the receptacle connector is 2 mm deep. Therefore, a 5×2 assembly module 22 such as that shown in FIG. 2 which is connected to two columns of terminals on the receptacle connector 2, is 4 mm deep.

The shielded header connector 24 pictured in FIG. 2 is a 5×6 module, i.e. it is connected to 5 rows and 6 columns of the receptacle connector 2. Therefore, there is room in the header connector 24 to receive three of the 5×2 assembly modules. Of course, assembly modules 20 of the present invention may vary in size.

Figure 3:
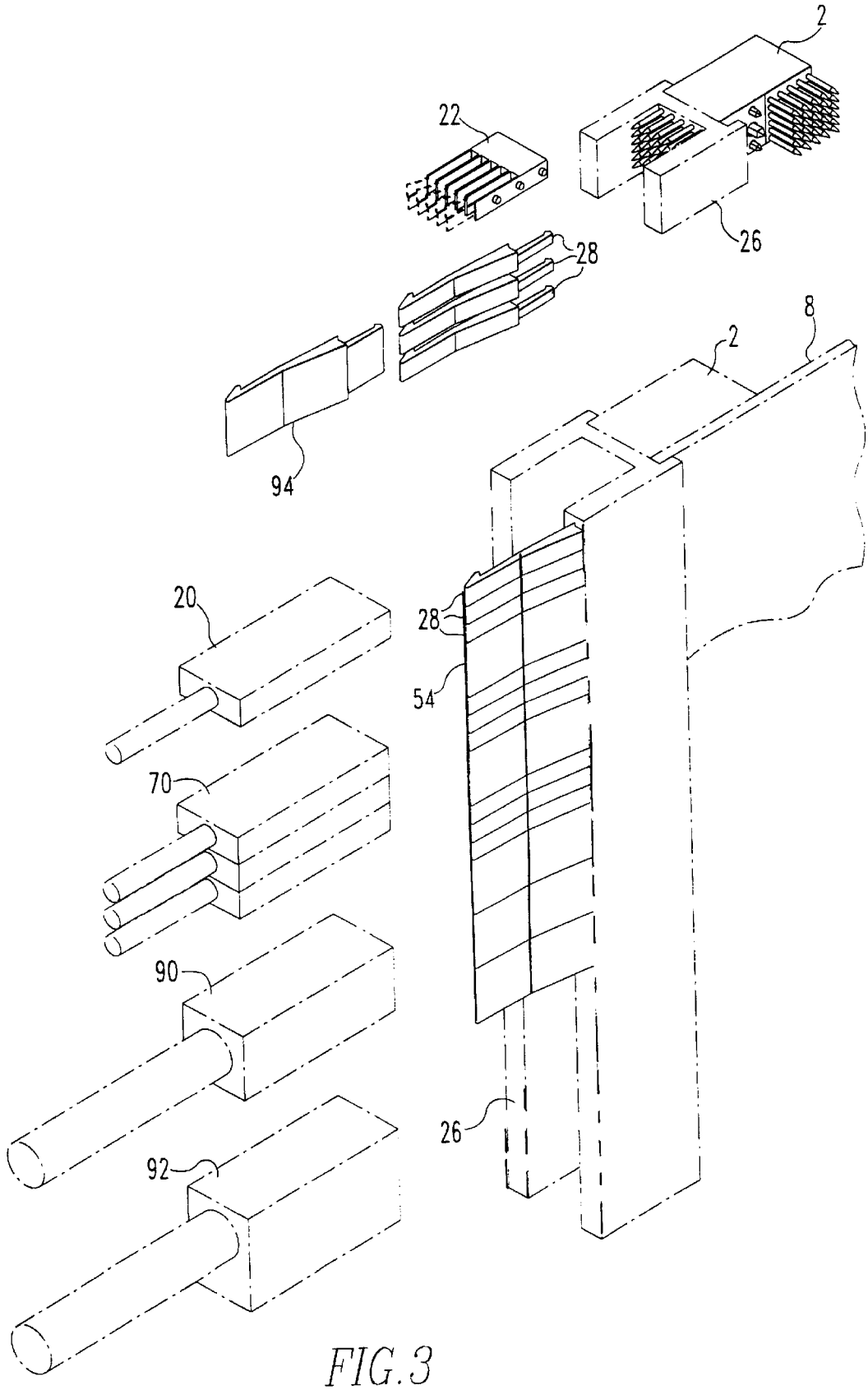
FIG. 3 provides a perspective view of a stacked header connector with various assembly modules.

FIG. 3 provides a view of a side by side vertically stacked arrangement of shielded header connectors 26. As shown, shielding housings 20 of the present invention may come in other sizes such as 5×6 90 and 5×8 92. An assembly module may be enveloped individually in a shielding housings 20 or alternatively several assembly modules 20 may be enveloped together in single shielding housing 90, 92. Also shown in FIG. 3, the connecting latch 28 component of the present invention can likewise vary to accommodate the various combinations of assembly modules, e.g. 5×6 connecting latch 94.

Figure 4:
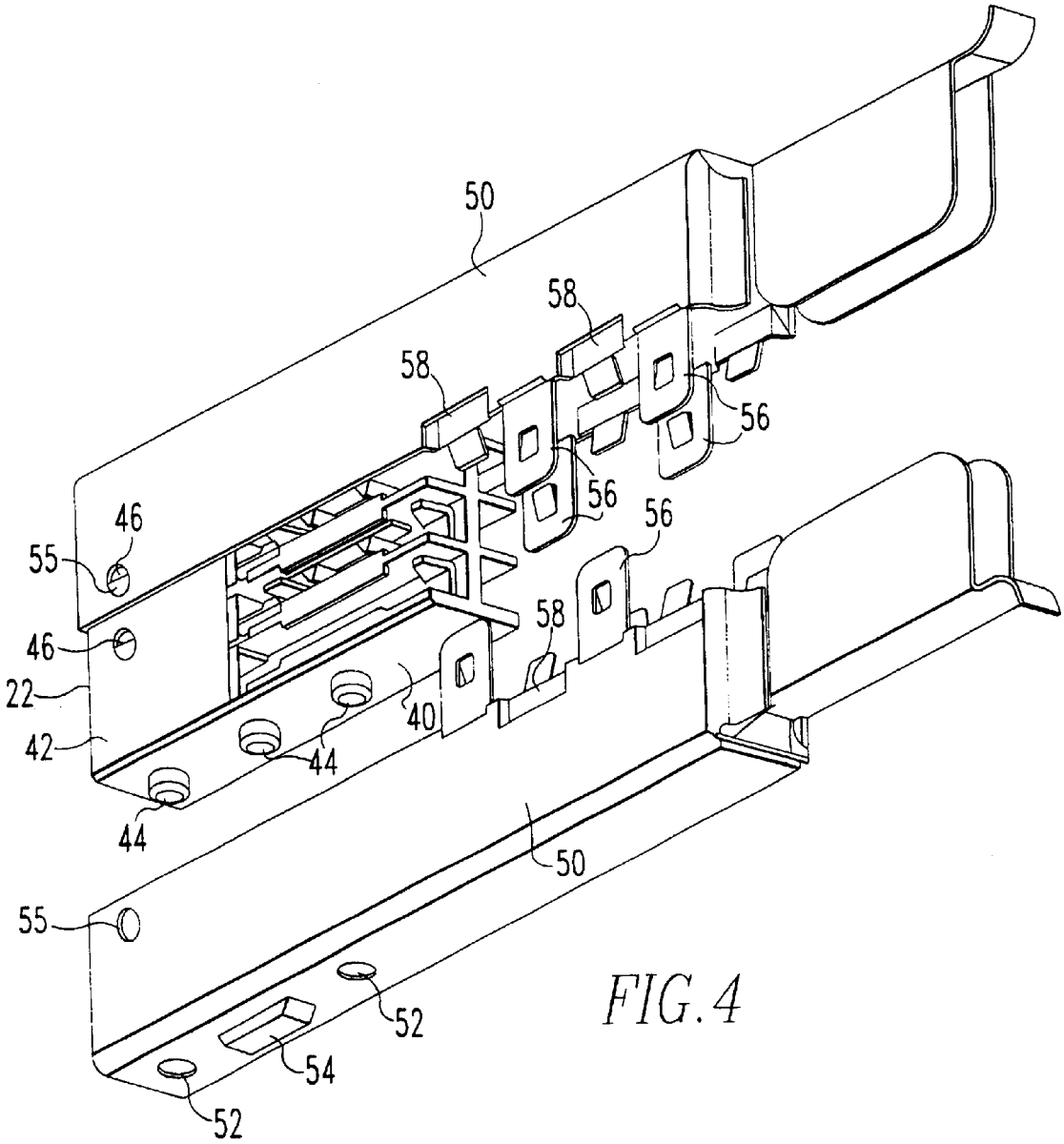
FIG. 4 provides a view of a partially exploded assembly module and shielding housing.

FIG. 4 provides a partially exploded view of a 5×2 assembly module 22 enveloped in a shielding housing 20. As shown, the inventive assembly module 22 has three side studs 44 on each of its two side surfaces 40. Similarly, two studs 46 are located on each of the module's lateral surfaces 42.

The shielding housing 20 comprises two half shells 50. The half shells 50 have appropriately located side recesses 52, 54 and lateral recesses 55 which cooperate with the previously mentioned studs 44, 46 when the two shells 50 are fitted over the connector module 22. Thus, when the two half shells 50 are drawn together around the assembly module 22, the side studs 44 are received into the side recesses 52, 54. Likewise, the lateral studs 22 are received into the lateral recesses 55. The studs 44, 46 operate to insure that the assembly module 22 is properly seated in the shielding housing 20.

Also shown in FIG. 4, the two half shells 50 of the shielding housing 20 comprise a series of latches 56 and latch slots 58. When the half shells 50 are placed together around the assembly module 22, the latches 56 insert into a corresponding slot 58 on the opposing half shell 50. The latch 56 and slot 58 combination along with the interconnection of the lateral studs 46 and lateral recesses 55 operate to secure the two half shells 50 around the assembly module 22.

Figure 14:
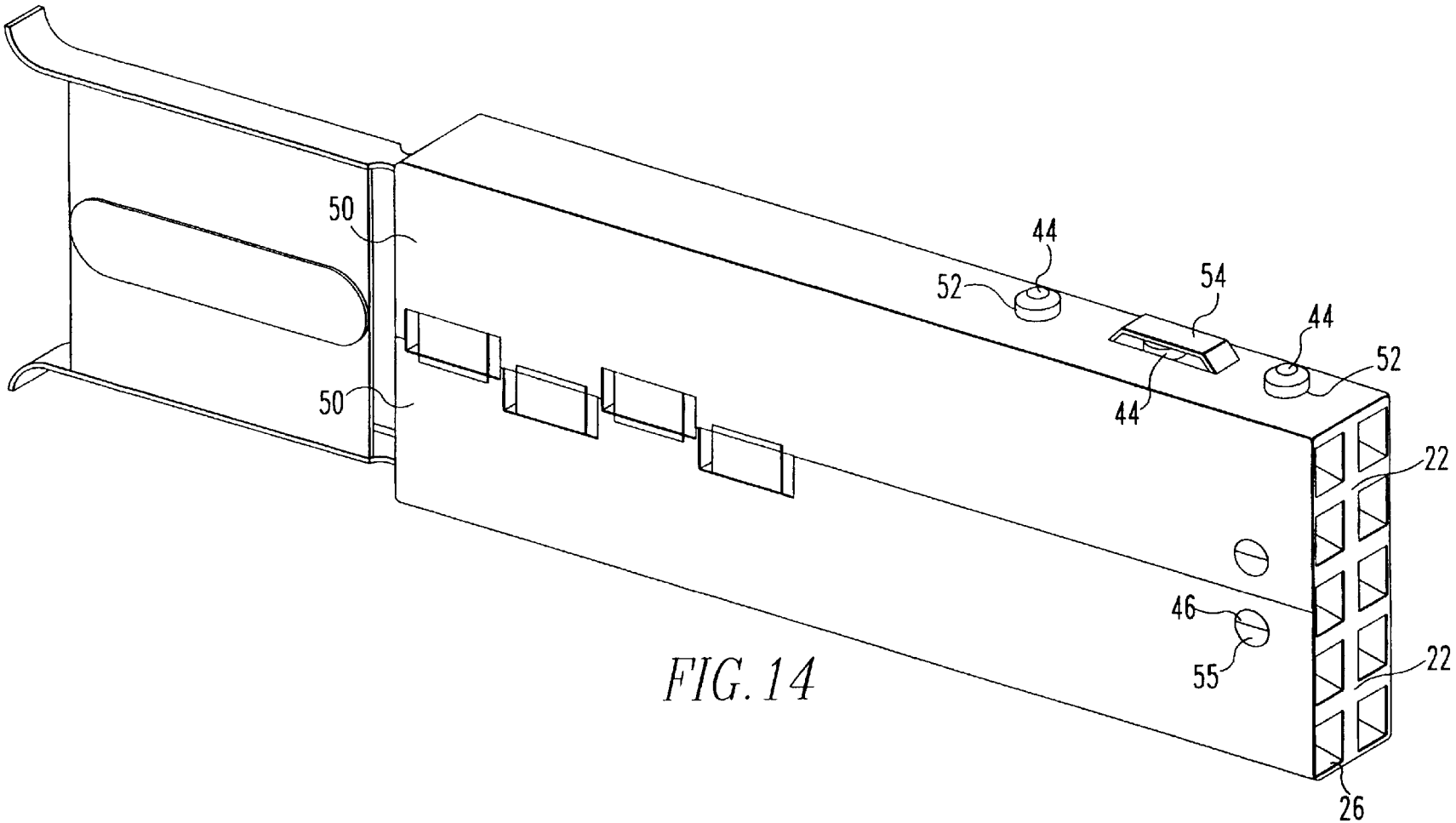
FIG. 14 provides a view of the 5×2 assembly module of FIG. 4 fully enveloped in a shielding housing.

FIG. 14 provides a perspective view from an opposing angle of the two half shells 50 and the assembly module 22 of FIG. 4 in a fully assembled position. As shown in FIG. 14, the two half shells 50, by means of the studs (44, 46), recesses (52, 55, 54), latches 56, and latch slots 58, lock into each other to form a 360 degree shell over the periphery of the assembly module 22 as well as a substantial surface of the signal cable. As shown in FIG. 14 and as was mentioned above, the assembly module 20 is a 5×2 module 22.

Figure 5C:
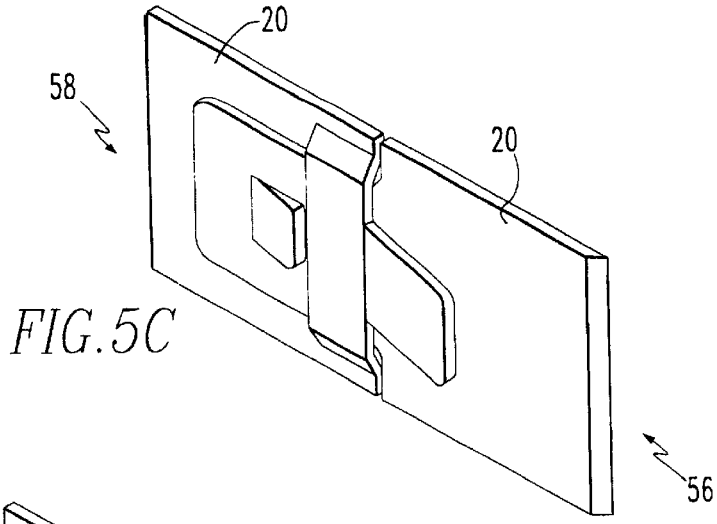
FIGS. 5A through 5F provide a detailed view of the latch and latch slot features of the shielding housing.
Figure 5B:
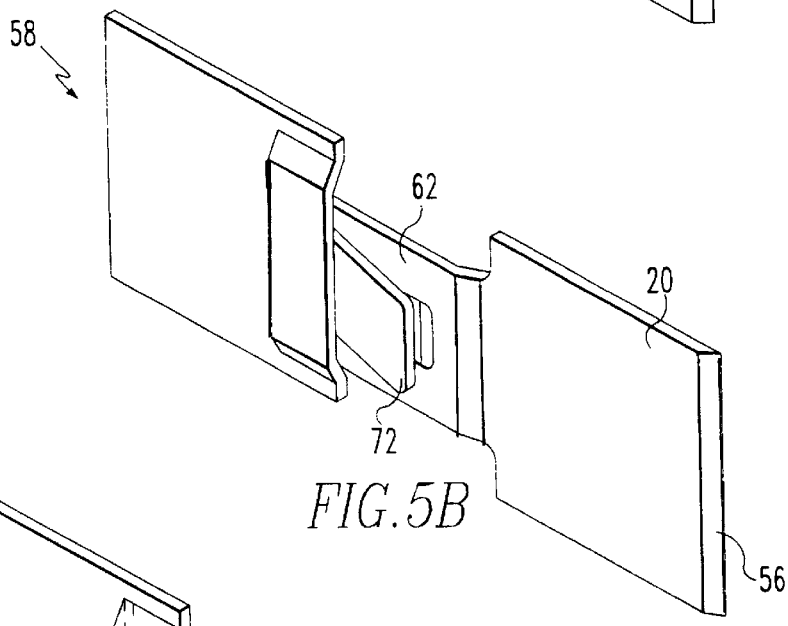
Figure 5A:
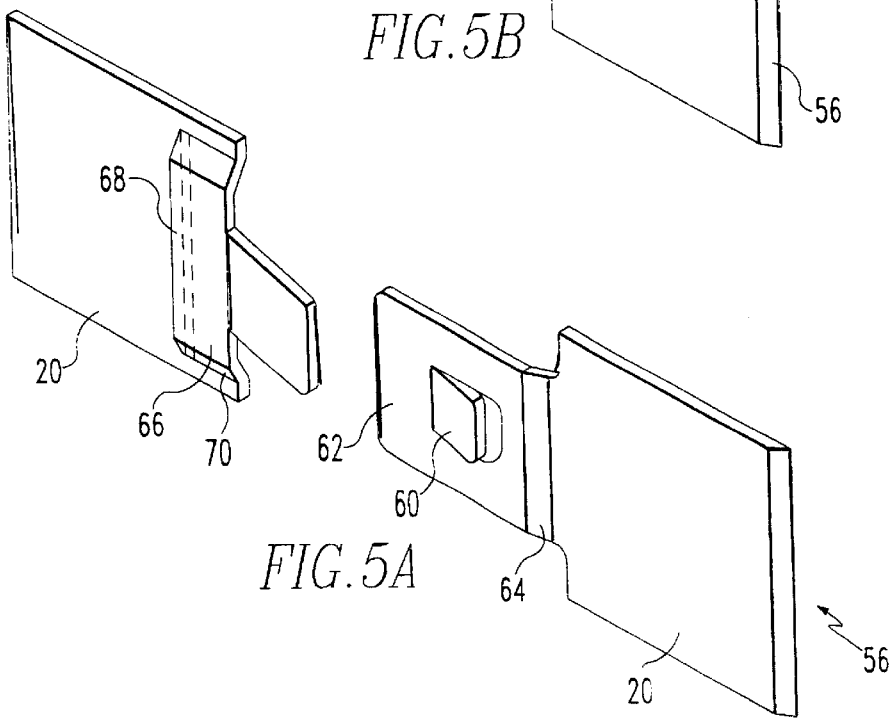
Figure 5F:
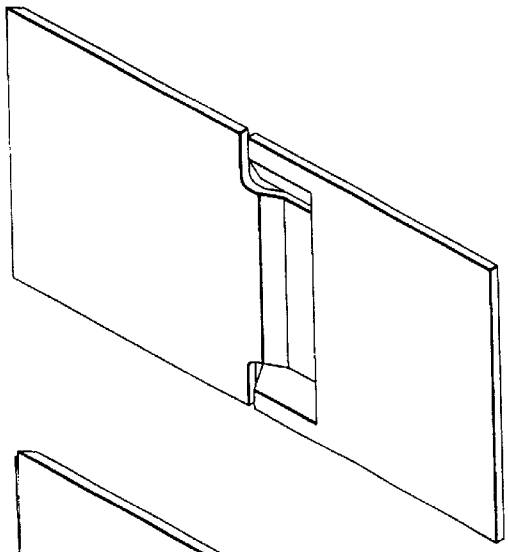
Figure 5E:
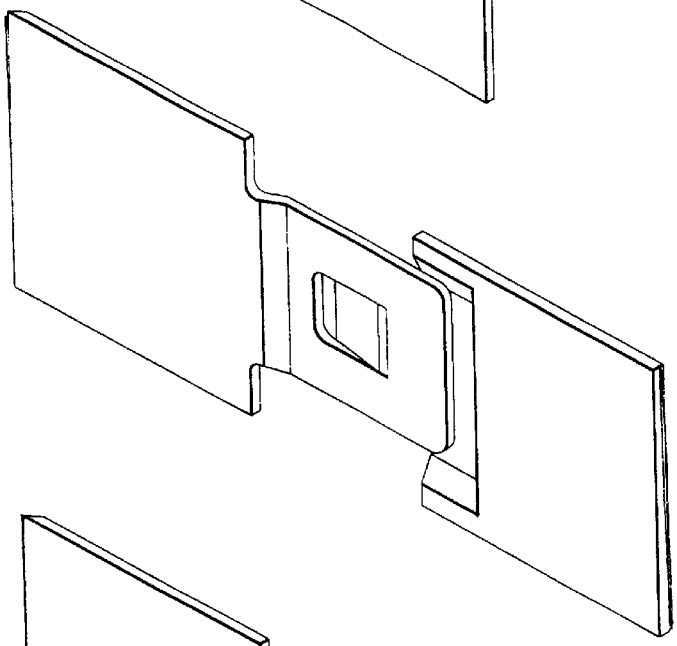
Figure 5D:
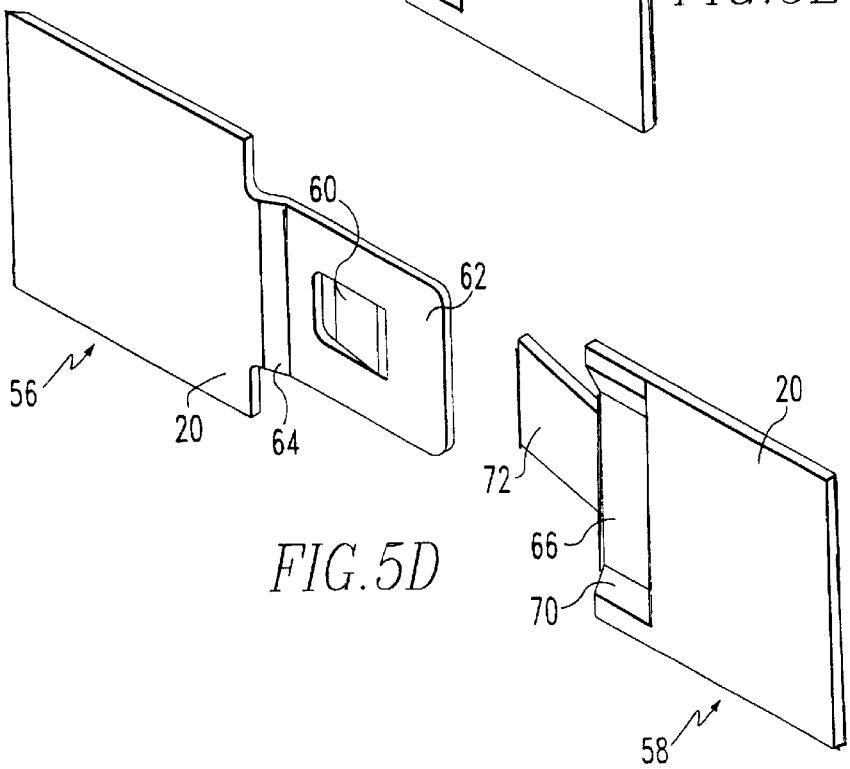

FIGS. 5A through 5C provide detailed frontal views of the latch 56 and slot 58 component of the shielding housing 20 in various stages of interconnection. FIGS. 5D through 5F provide corresponding rear views.

FIGS. 5A and 5D provide a view of the latch 56 and slot 58 when unconnected or in an "open" state. As shown, the latch 56 comprises a sheared cantilever beam 60 located on a tab 62. The tab 62 has been displaced over a small bend 64 with respect to the plane of shielding housing 20. Although the cantilever beam 60 is shown to be sheared from the tab, it should be noted that the cantilever beam instead of being sheared from the tab could alternatively be a detent or bump and the beam would function properly to secure the latch into the latch slot.

Also shown in FIGS. 5A and 5D, the receiving slot 58 is formed between a flat lug 66 and the plane of the shielding housing which is represented by dotted line 68. The flat lug 66 is connected to the shielding housing 20 by two bent members 70. A flat bias 72 extends from the flat lug 66.

FIGS. 5B and 5E provide a view of the latch 56 partially engaged with the latch slot 58. As shown, during the initial engagement, the tab 62 located on the latch 56 side contacts the flat bias 72 located on the corresponding latch slot 58 side. Provided the two are on the same plane, the latch 56 is easily inserted into latch slot 58.

FIGS. 5C and 5F provide a view of the latch 56 and latch slot 58 in the fully engaged or "home" position. As shown, the latch tab 62 engages behind the flat lug 66 edge and thereby secures the latch 56 in the latch slot 58.

Figure 6A:
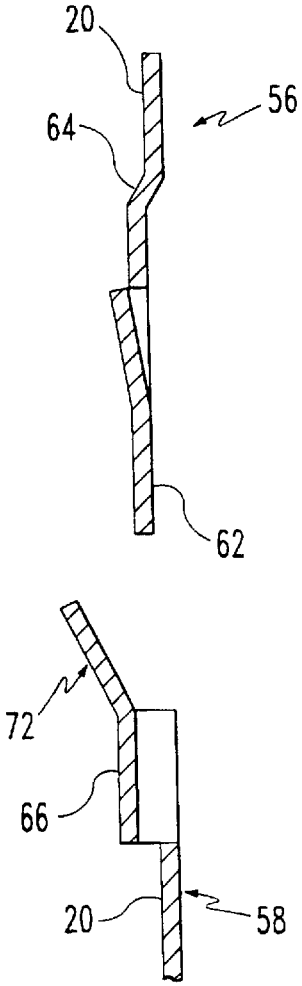
FIG. 6 provides a cross-sectional view of the latch and latch slot features of the shielding housing.
Figure 6B:
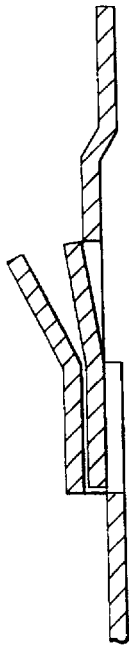
Figure 6C:
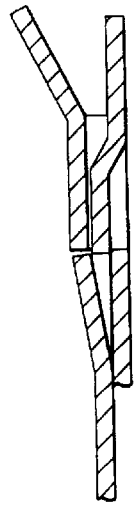

FIGS. 6A through 6C provide a cross-section view of the latch 56 and latch slot 58 in the three stages of engagement described above, i.e. open, engaged, and home. FIG. 6A provides a view of the latch 56 and latch slot 58 in an open state. FIG. 6B provides a view of the latch 56 and latch slot 58 in a partially engaged state. FIG. 6C provides a view of the latch 56 and latch slot 58 in the home position.

Figure 7:
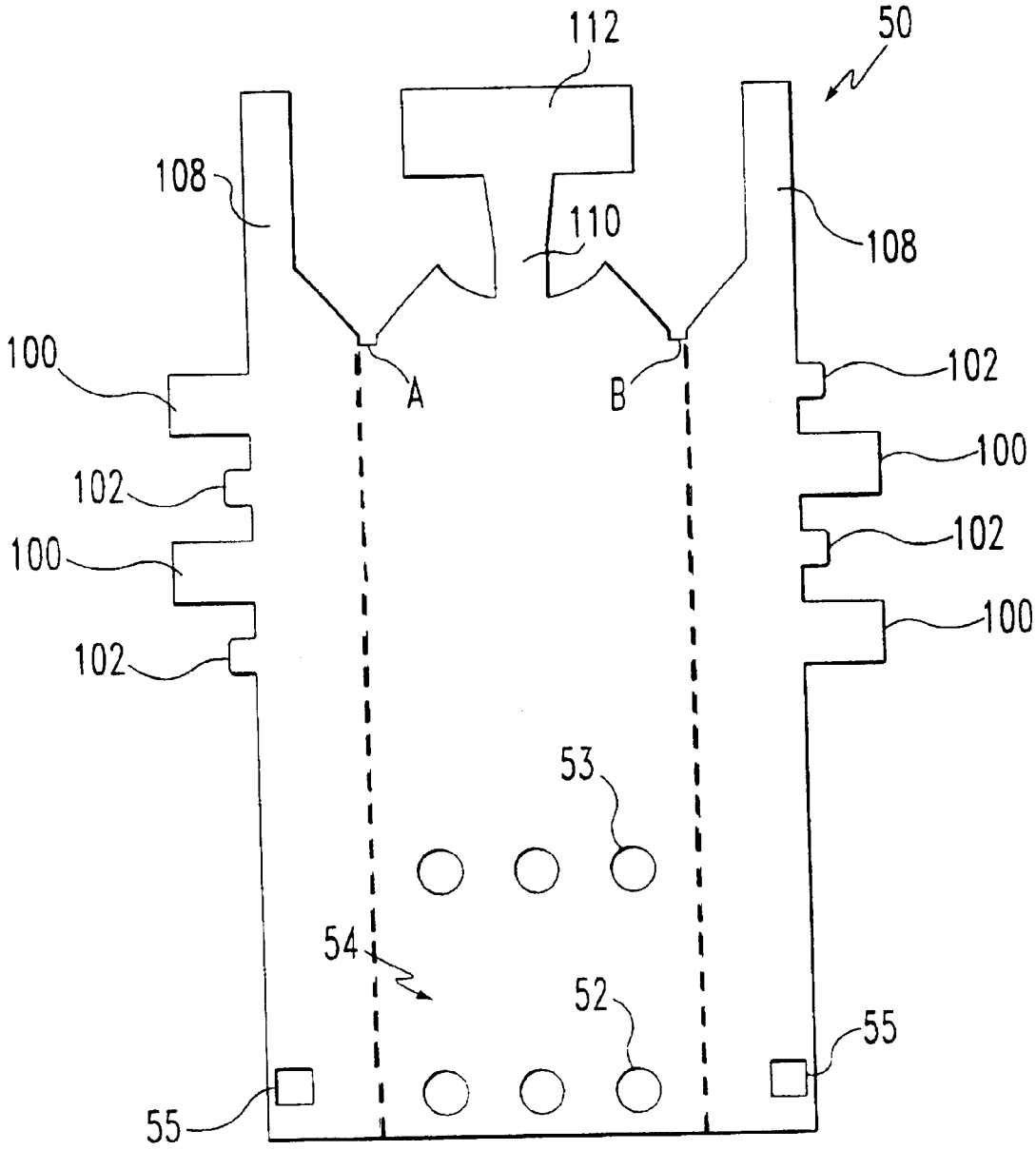
FIG. 7 provides a view of a flat stamp layout of one half shell of the shielding housing.

FIG. 7 provides a flat stamp layout view of a half shell 50 of the shielding housing 20. The flat stamp layout can be folded along lines A and B so as to form a half shell 50 into which three assembly modules may be enveloped.

As shown in FIG. 7, circular side recesses 52 and lateral recesses 55 are located at one end of the stamped shield half shell 50. Located linearly away from each of the circular side recesses 52 is a somewhat larger diameter recess 52. In the area of the half shell between each pair of recesses is located, but not shown, a raised dimple recess 54 which, as will be discussed below, comes into contact with a grounding spring located in a header connector. It should be noted that the half shell 50 depicted in FIG. 7 has three pairs of circular recesses each of which is meant to engage the lugs of an assembly module. Along each side of the half shell 50 are located alternatively tabs 100 and flat biases 102. The tabs 100 are located opposite the flat biases 102 which appear at the same level on the opposing side of the half shell 50. Thus, when the half shell 50 is folded and placed around an assembly module 22, the tabs 100 and flat biases 102 are located opposite one another. It should be noted that the tab 100 and flat bias 102 of FIG. 7 are machined into the latch 56 and latch slot 58 described above in connection with FIG. 4.

At the furthest end of the half shell 50 are located two lobes 108. At that same end of the half shell 50 is located a central neck 110 with an adjoining flap 112. The central neck 110 and adjoining flap 112 encircle the cable when the half shell 50 is formed and placed around the assembly module 22.

Figure 8D:
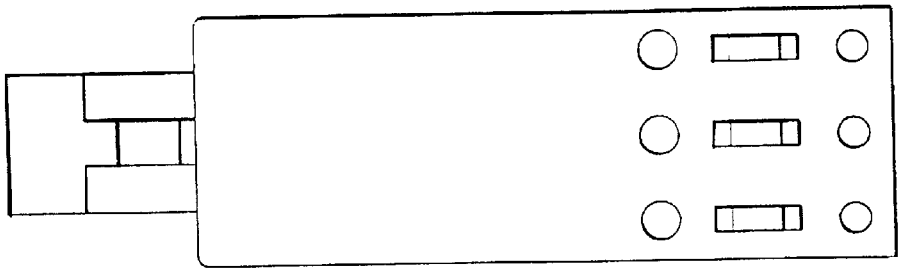
FIGS. 8A through 8D provide various views of one half shell of a shielding housing formed from the flat stamp layout shown in FIG. 7.
Figure 8C:
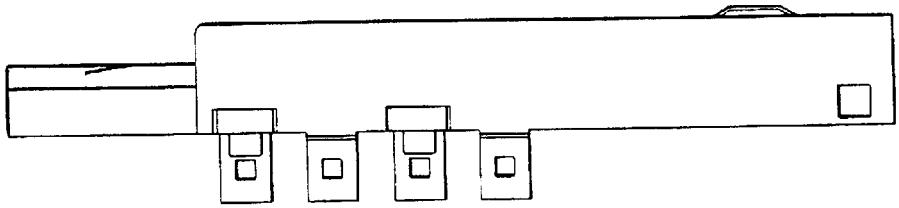
Figure 8B:
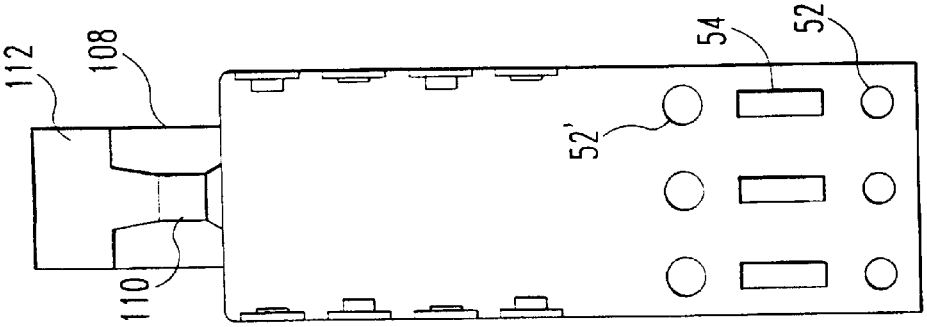
Figure 8A:
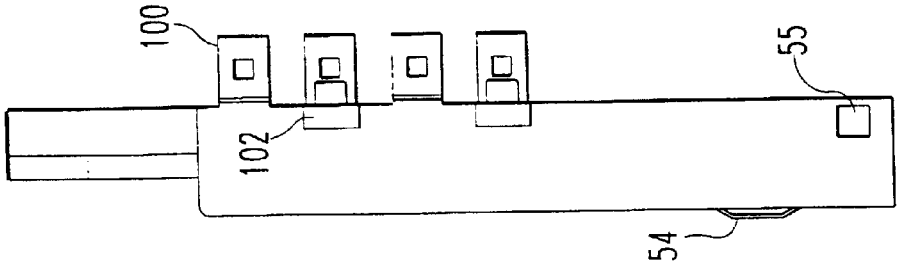

FIGS. 8A through 8D provide various views of a half shell 50 formed by folding the stamped half shell 50 of FIG. 7 along lines A and B. FIG. 8A provides a view of the portion of the half shell folded up from line A. FIG. 8C provides a view of the portion of the half shell 50 folded up from line B. FIG. 8B provides a view of the interior of a side of the half shell 50. As shown in FIG. 8B, the half shell 50 has three combinations (52 and 54) of recesses, each of which is meant to engage with the studs of an assembly module. FIG. 8D provides a view of the exterior of the half shell 50 from a perspective opposite that of FIG. 8B.

Figure 9:
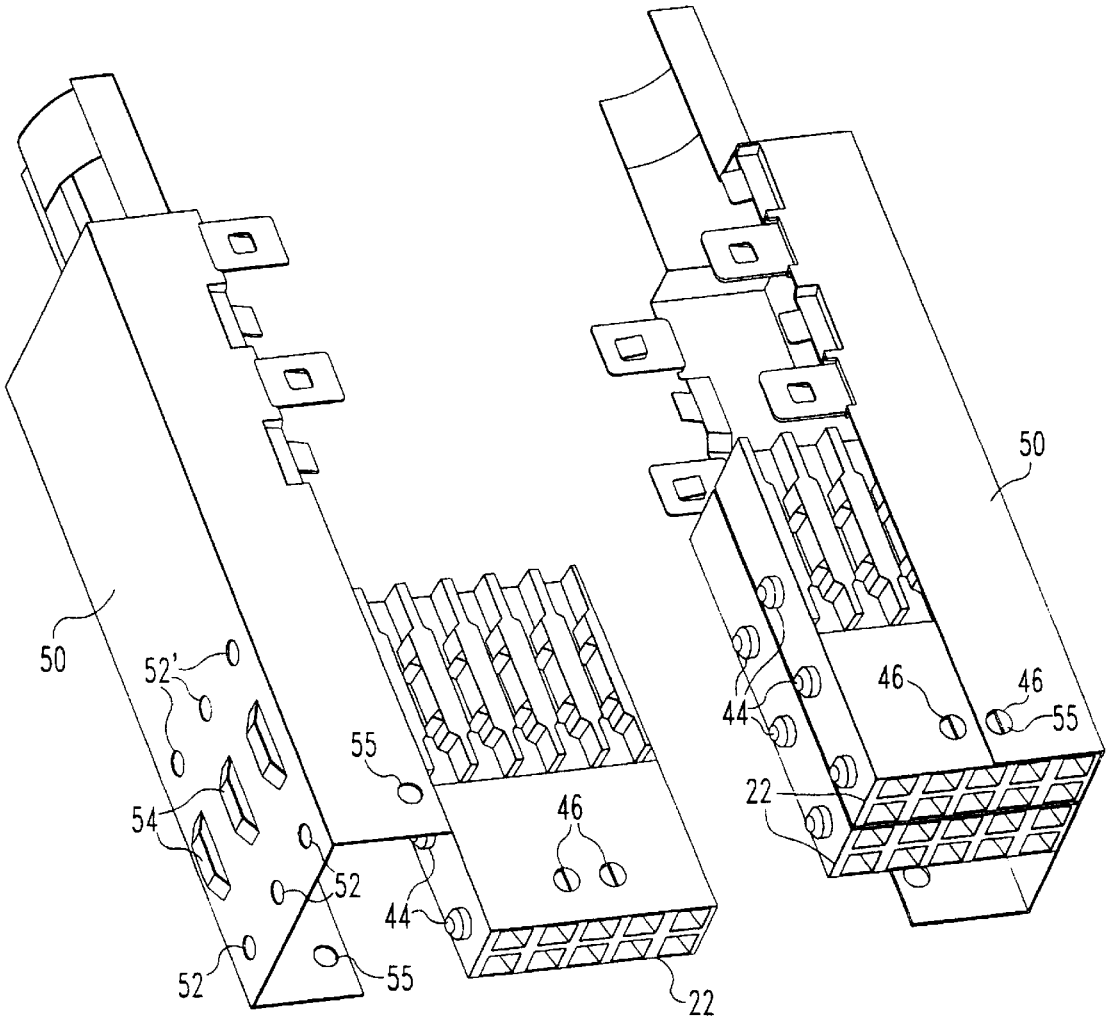
FIG. 9 provides a view of a partially exploded three assembly modules partially enveloped in the shielding housing of FIGS. 7 and 8.

FIG. 9 provides a partially exploded view of a shielding housing 20 composed of half shells 50 formed around three assembly modules 22. The lateral stud 46 cooperates with the lateral recess 55 so as to secure the half shells 50 to the assembly modules 22. The side studs 44 on each module cooperate with the side recesses 52, 54 so as to insure that each module is properly seated in the housing 20.

The raised dimple recess 54 and the studs 44 protruding through the side recesses 52 also function to guide the shielding housing 20 into a header connector 24. As explained below in connection with FIG. 10, when the shielding housing 20 is placed into a header connector, the protruding side studs 44 and the dimple recess 54 cooperate with slots located in the header connector walls thereby providing a guide for easy insertion of the shielding housing 20 into the header connector.

Figure 15:
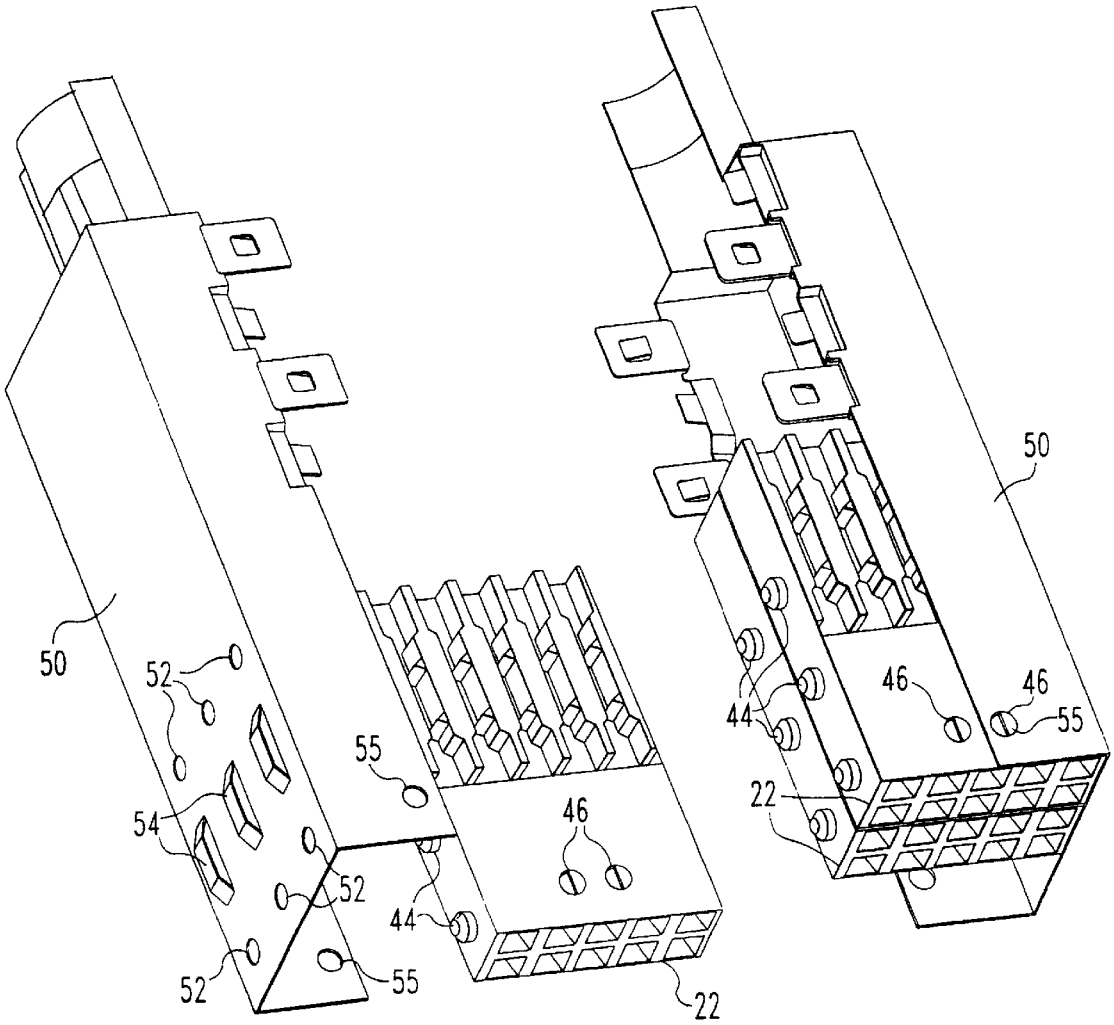
FIG. 15 provides a view of an exploded 5×6 assembly module and partially enveloped in the shielding housing of FIG. 9.
Figure 15A:
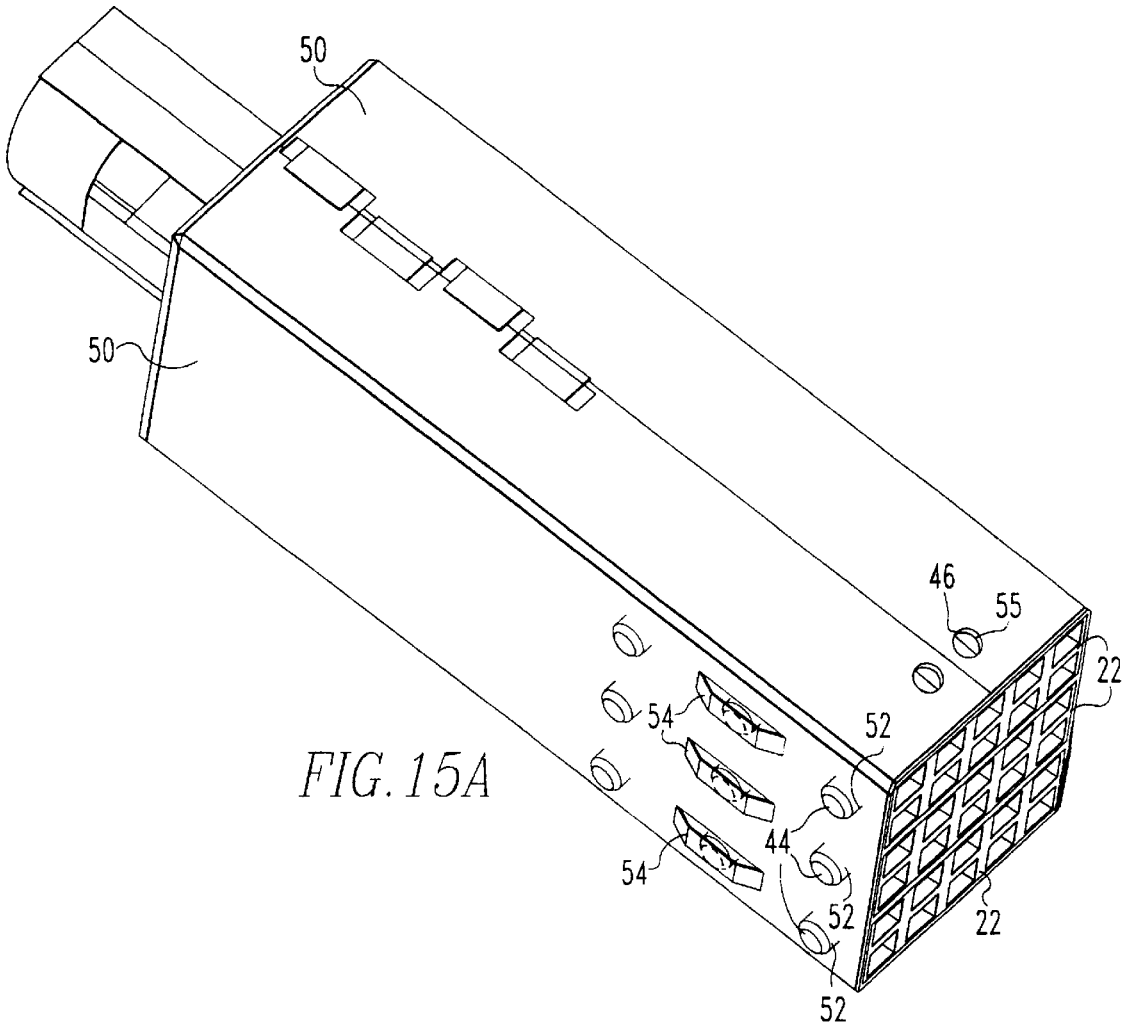
FIG. 15A provides a view of a 5×6 assembly module fully enveloped in the shielding housing as shown in FIG. 9.

FIG. 15A provides a perspective view of the three assembly modules fully enveloped within the assembly module of FIG. 9.

Figure 10A:
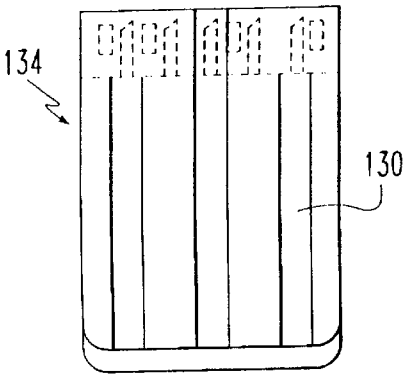
FIGS. 10A through 10G provide various views of the inventive shielded header connector.
Figure 10B:
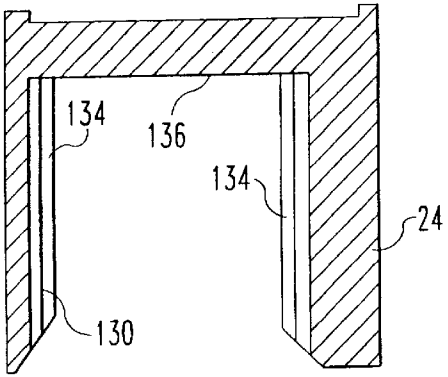

FIGS. 10A through 10G provide various views of the inventive shielded header connector 24. The header connector depicted is a 5×6 module. FIG. 10A provides a view of the interior of a side wall of the header connector 24. As shown, the header connector 24 has three slots 130 on the interior side wall. In the present invention, such slots 130 appear on the two side walls 134. These slots 130 accept the raised dimple recesses 54 and protruding side studs 44 located on the exterior of a shielding housing 22. The dimple recess 54 and studs 44 are received into the slots 130 and thereby guide the shielding housing 20 and the assembly modules located therein, into the correct location within the header connector 24.

Figure 10C:
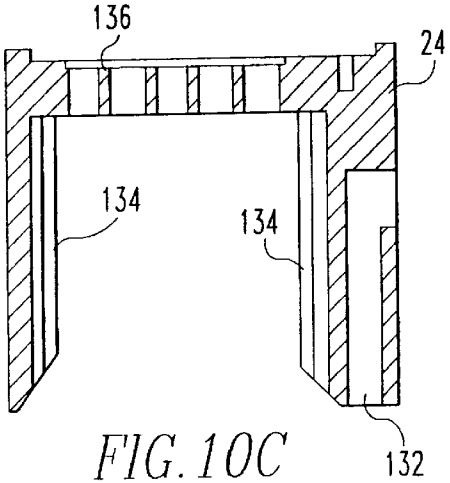

FIG. 10C provides a sectional view of the header connector 24. As shown, one side wall 134 of the header connector contains a recess 132. This recess 132 is designed to accept the leg portion 140 of the connecting latch 28. FIG. 10G shows a sectional view of this side wall. As shown, the recess can accept three separate leg portions 140 of a connecting latch 28. These legs may be either part of a single latch or multiple latches.

Figure 10D:
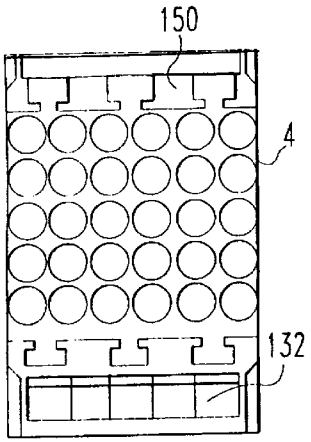
Figure 10E:
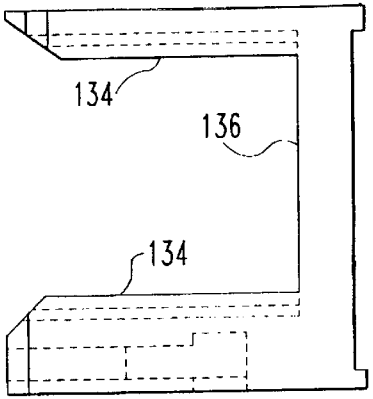
Figure 10F:
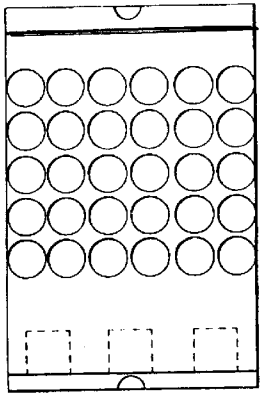
Figure 10G:
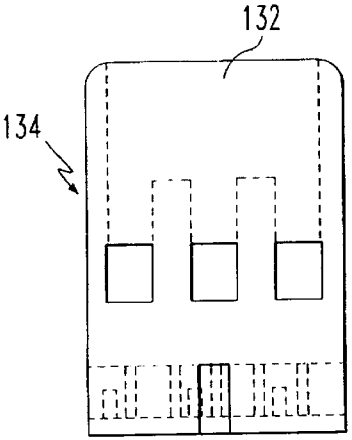
Figure 11A:
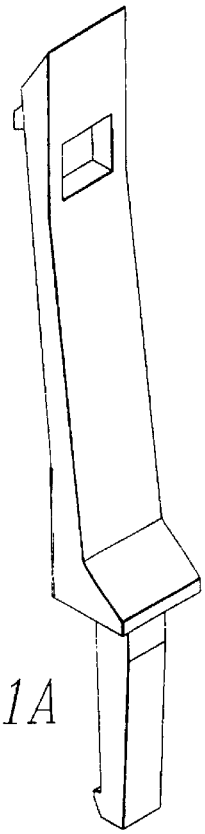
FIGS. 11A through 11G provide various views of the inventive connecting latch.
Figure 11B:
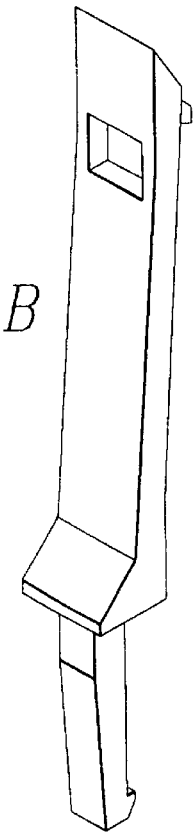
Figure 11C:
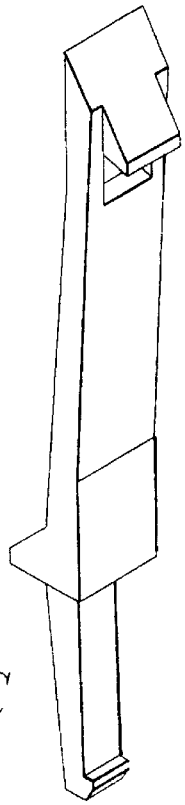
Figure 11D:
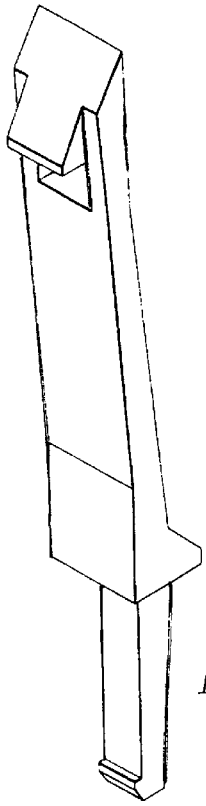
Figure 11E:
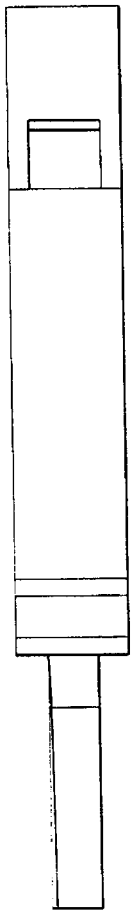
Figure 11F:
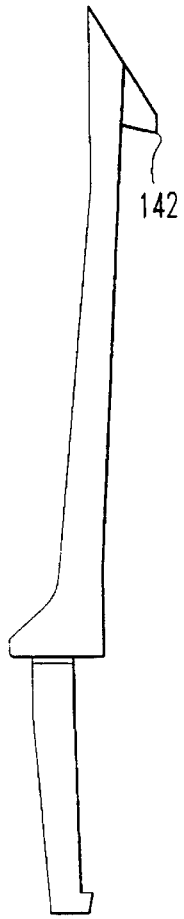
Figure 11G:
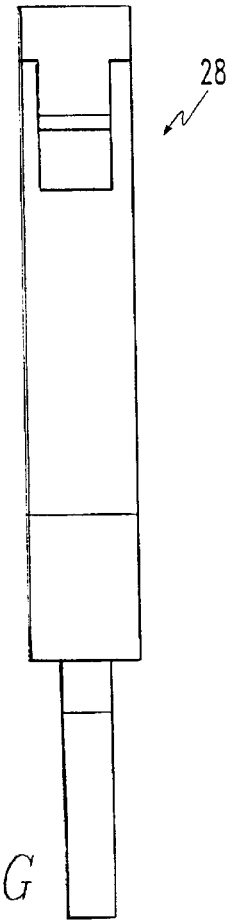

FIG. 10D provides a end sectional view of the header connector 24 from the perspective of one looking into the base terminal wall of the header connector 24. As shown, the base wall 136 has multiple terminals extending therefrom. The header module shown in FIG. 10D is a standard type and therefore the terminals are in a 5×6 arrangement. Along the sides of the terminal walls are located a series of ground springs 150. A ground spring 150 is located on each side wall aligned between each row of terminals on the base wall. When a shielding housing 20 is inserted into a header connector 24, the dimple recesses 54 on the exterior of the housing come into contact with the ground springs 150 and thereby provide grounding to the shielding housing.

As noted above in the discussion of FIG. 10A, the present inventive header connector 24 contains three slots 130 on two opposite header walls 134. These slots accept the dimple recesses 54 located on the exterior walls of the shielding housings 20 which are placed into the header 24. In contrast, in prior art headers two dimple ribs were located on a single header wall opposite a single slot located on the opposite header wall. The increase in the number of slots in the header walls of the present invention allows for more ground contact springs on the header walls which results in better force balance and multi-point grounding. Furthermore, the use of multiple slots on two header walls provides superior guidance when the shielding housing is inserted into the header. It is also within the scope of the present invention, to form the header walls so that dimples are present on one wall and slots are present on the other wall. In this embodiment the surface of the shielding housing would also have dimples on one exterior surface and slots formed on the opposite surface. This has the effect of polarizing the connection between the header connector and the shielding housing.

FIGS. 11A through 11G provide various perspective views of connecting latch 28. The connecting latch 28 shown is one typically used with a 5×2 assembly module. As shown, such a latch 28 has a leg 140 which enters the recess 132 located in the header-wall previously shown in FIG. 10. At the opposite extremity of the latch 28 is located a spring clamp 142 or shoulder which is used to fix the shielding housing 20 to the header connector 24.

Figure 12A:
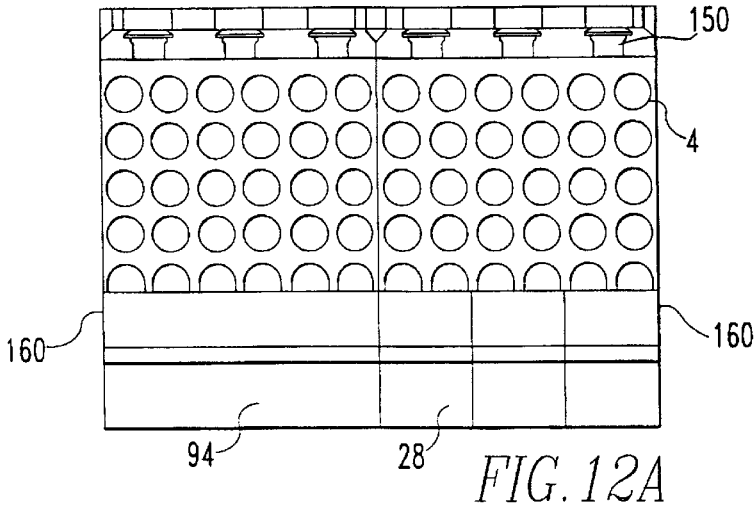
FIGS. 12A through 12D provide various views of a shielding housing and connecting latch assembled with a shielded header connector.
Figure 12B:
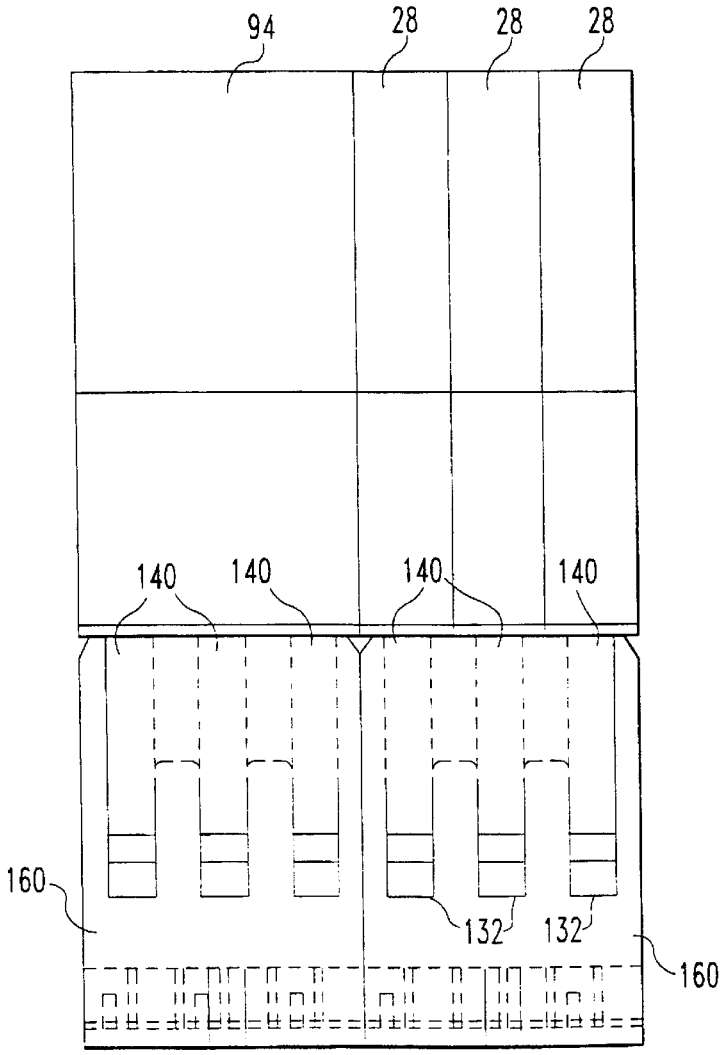
Figure 12C:
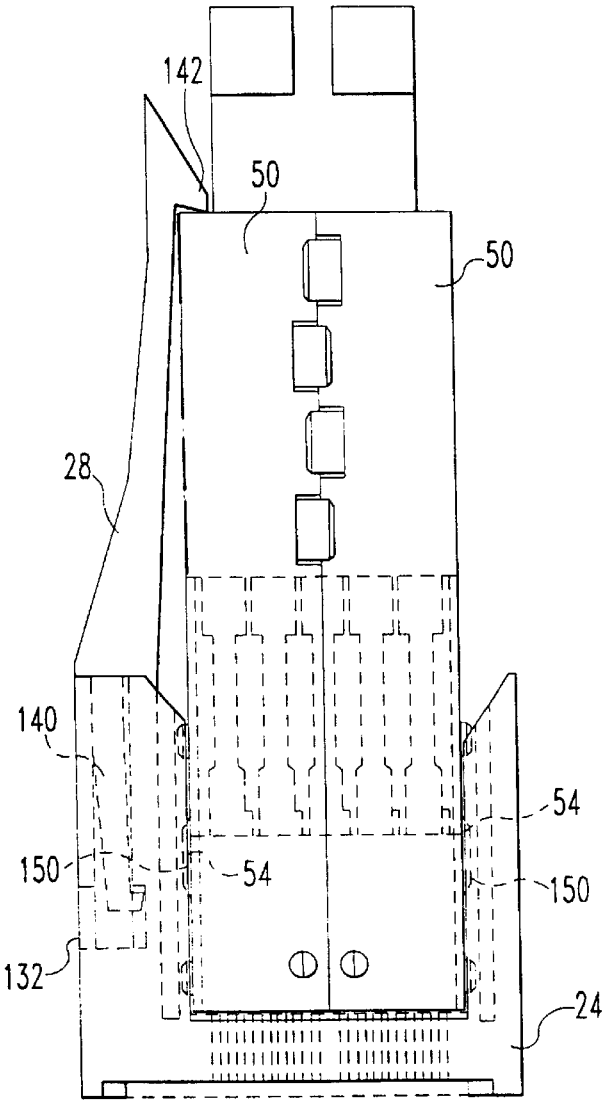

FIGS. 12A through 12D provide various perspective views, partially in section of the header connector 24 in various stages of cooperation with the latch 28 and connector receptacle 20. As shown in FIG. 12C, the latch 28 secures the shielding housing 20 to the header connector 24. The leg 140 portion of the latch 28 is inserted into the header wall recess 132. The spring clamp 142 portion of the latch 28 is secured to the shielding housing 20. The latch 28 thereby operates to secure the shielding housing 20 and the assembly modules 22 located therein to the header connector 24. It is also within the scope of the present invention to integrally form latch 28 and header connector 24.

Figure 12D:
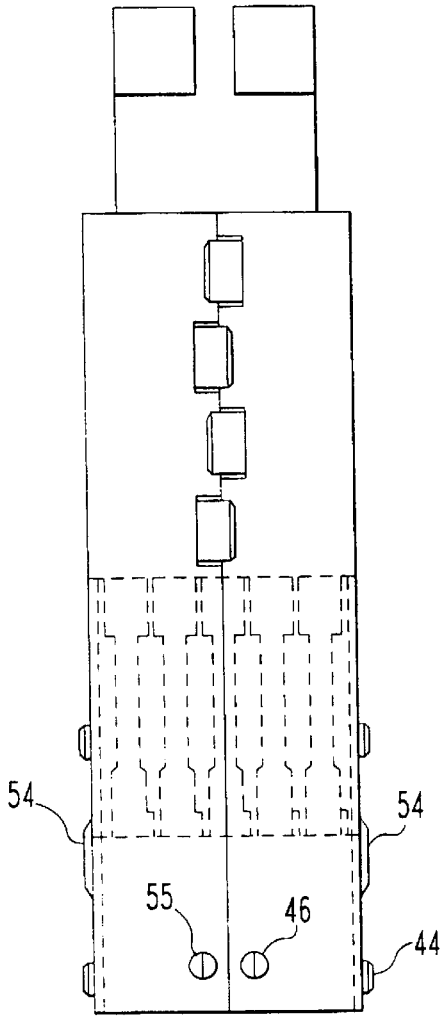

FIG. 12D provides a side view of the shielding housing 20. As shown, the dimple recesses 54 extend from the wall of the shielding housing 20. Referring to FIG. 12C, when the shielding housing 20 is inserted into the header connector 24, each dimple 54 contacts a ground spring 150 located on the interior wall of the header connector 24. The contact between the dimples 54 and the ground springs 150 completes the grounding loop between the shielding housing 20 and the header connector 24. Local areas of the dimple recesses 54 may be gold plated so as to minimize impedance.

FIG. 12B provides a side lengthwise view of the latch 28 and header connector 24 combination shown in FIG. 12C. As shown in FIG. 12B, two header connector modules 160 are shown stacked together. A first header connector module 160 has three 5×2 latches 28 inserted thereto. The sectional view of the header connector shows the leg 140 portion of each of the three latches 28 located in the header wall latch slot 132. A second header connector module 160 has a single 5×6 latch 94 inserted therein. The three legs 140 of the single 5×6 latch 94 can be seen in the sectional depiction of the header module 160.

FIG. 12A provides a lengthwise view of the base wall of the header connector modules 160 shown in FIG. 12B. As shown, each 5×2 module has a header wall ground spring 150 associated with it. By providing a ground spring 150 for each 5×2 module, the present invention insures sufficient grounding for each assembly module.

Figure 13A:
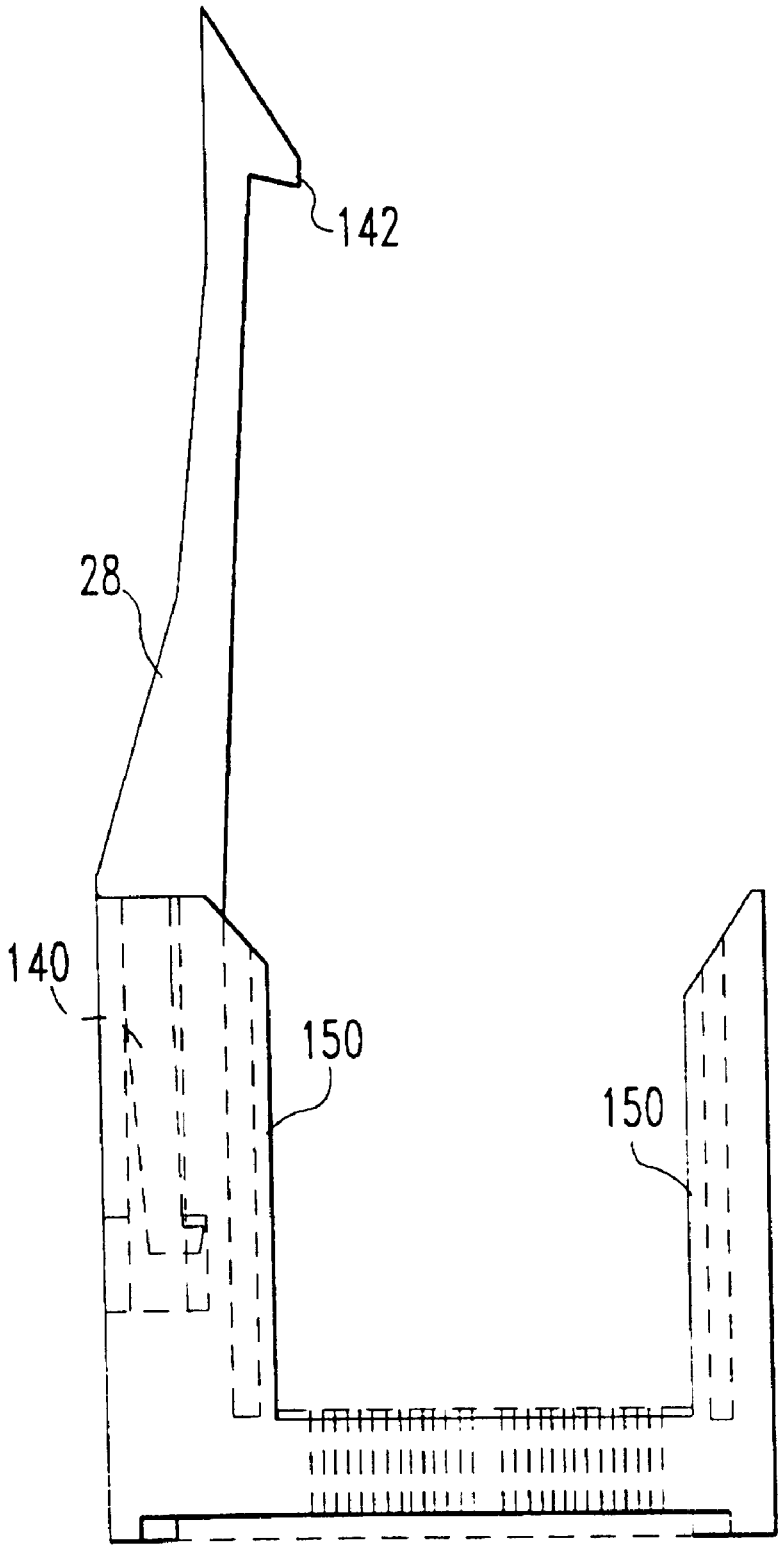
FIGS. 13A through 13C provide various views of a connecting latch connector integrated with a shielded header.
Figure 13C:
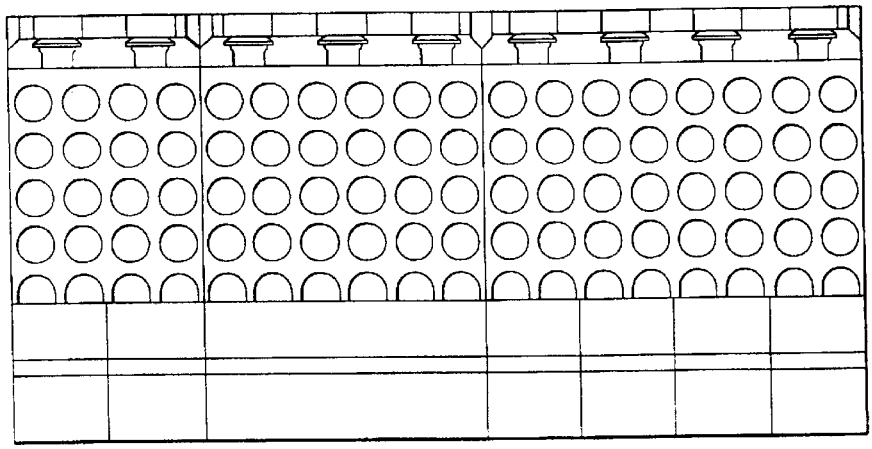
Figure 13B:
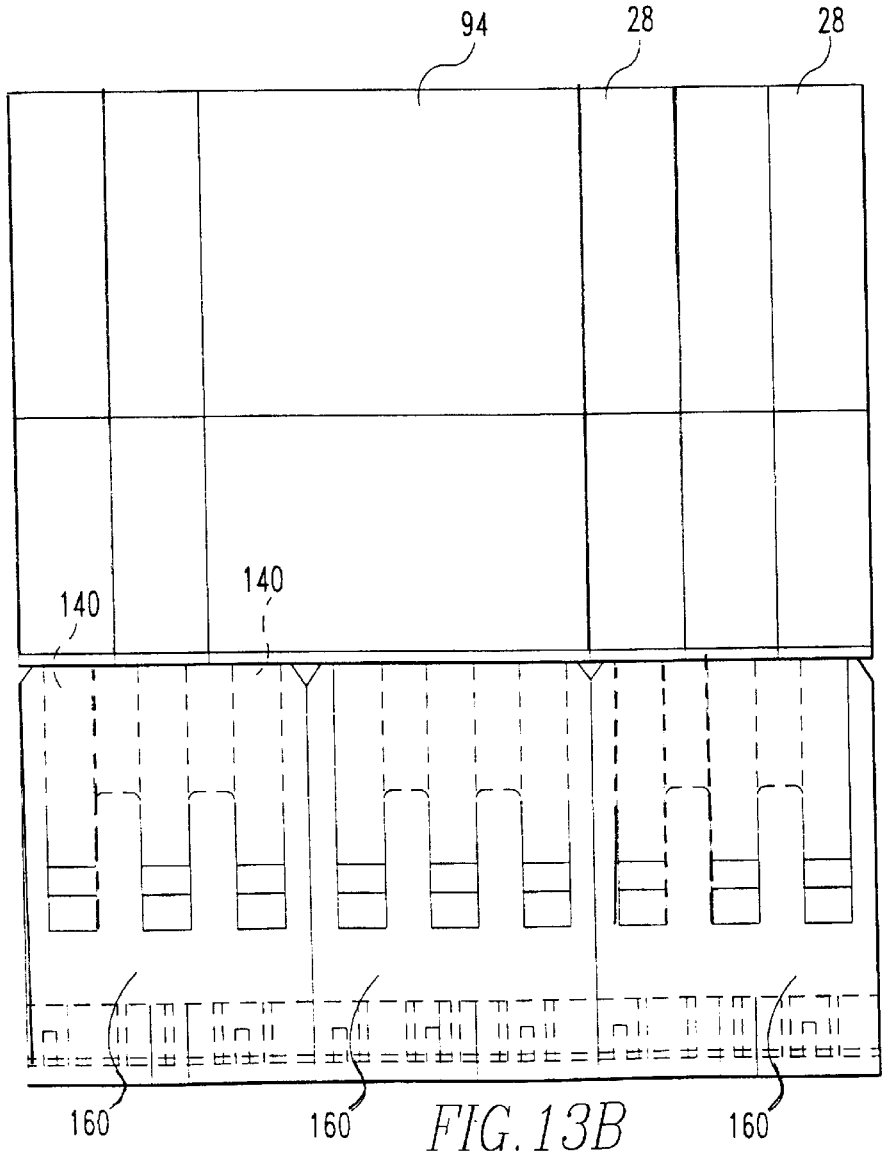

The present inventive shielded connector maintains the modular characteristics of prior art METRAL™ connectors. As discussed above, FIG. 11 depicts a single latch 28 with a single latch spring clamp 142. FIG. 12B illustrates that a header module 160 might have three individual 5×2 latch modules 28 attached or alternatively have one 5×6 module 94. As shown in FIG. 13B a latch may also overlap header modules.

Referring to FIG. 13B, the header module 160 shown to the furthest right in the Figure has three 5×2 latches 38 inserted thereto. The middle header module 160 has a single 5×2 latch 28 along with a portion of a 5×6 latch 94 inserted thereto. The 5×6 latch 94 overlaps between the module 160 shown in the middle and the module 160 shown to the furthest left. The single integrated 5×6 latch 94 can be used with its three legs 140 inserted into one header module, or two legs in a first module and the third leg in the adjacent header module. The inventive header connector 24 has been designed to allow for such overlap and modular use of components. The ability to overlap latches between modules has the added benefit of aligning adjacent modules 160 so as to maintain unity and end-to-end stackability of the total connector module.

Figure 16:
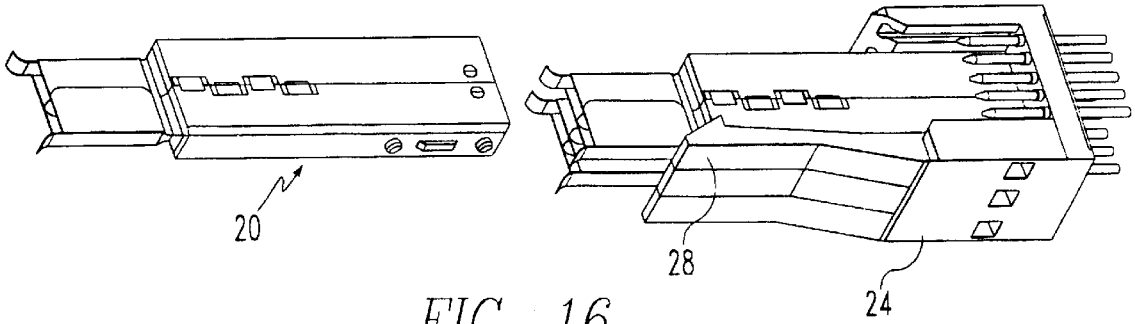
FIG. 16 provides a view of three 5×2 assembly modules of the type shown in FIGS. 4 and 14 received in a header connector and secured by a latch mounted in a header connector wall.
Figure 17:
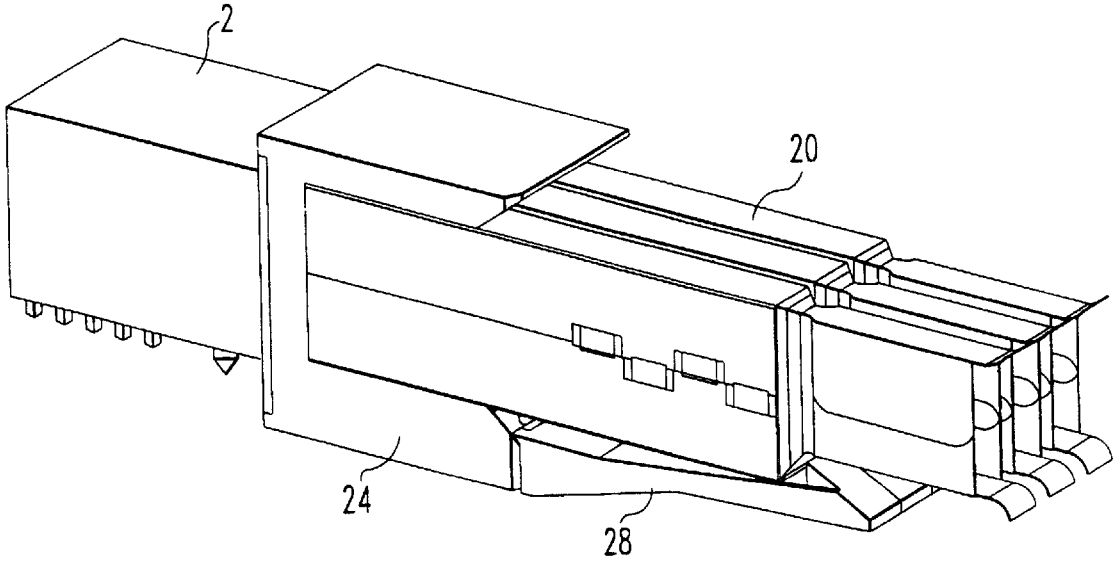
FIG. 17 provides a view of the three 5×2 assembly modules secured in header connector.
Figure 17A:
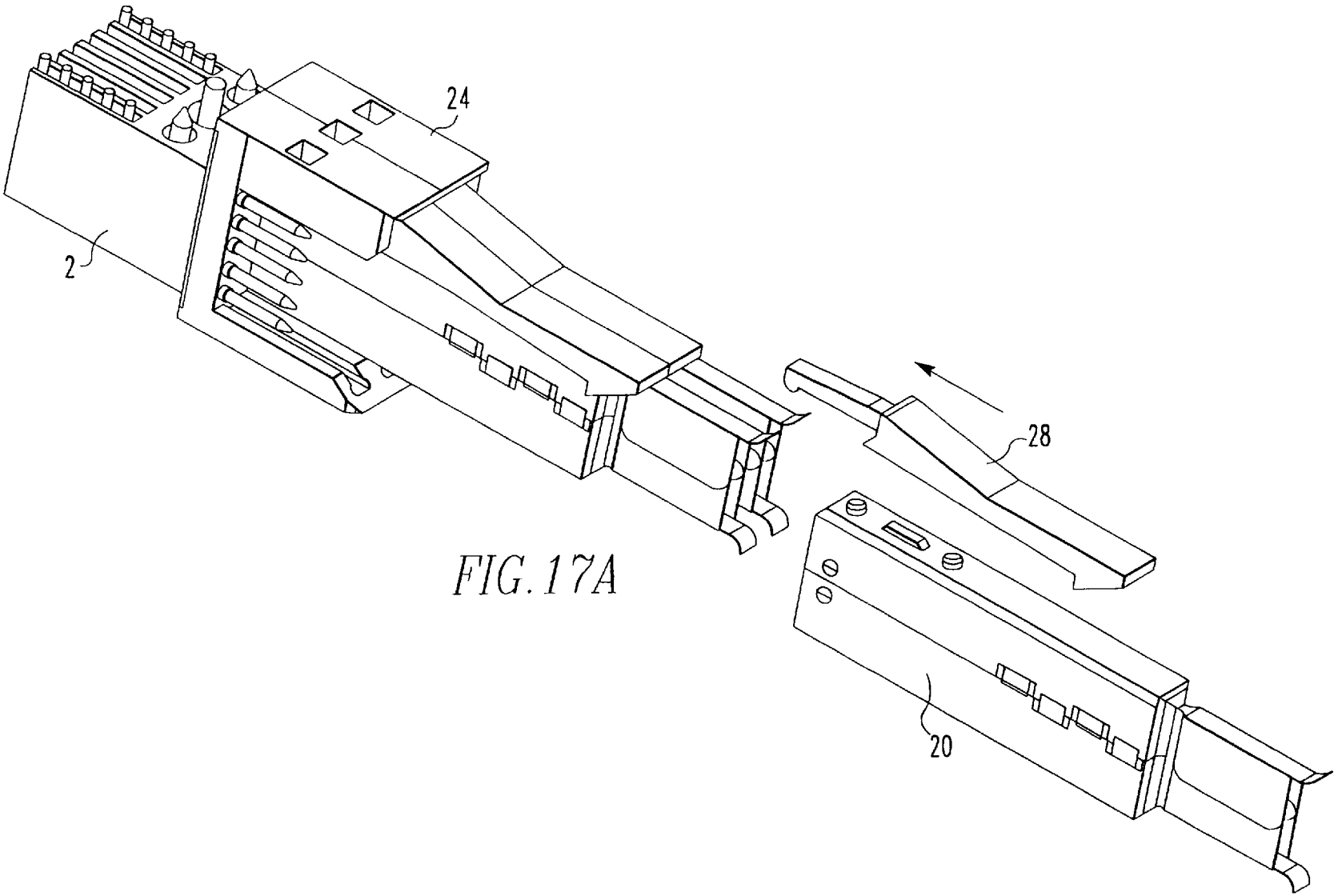
FIG. 17A provides a view from a bottom perspective of the assembly module illustrated in FIG. 17.

The modularity of the present invention is not limited to the latches but extends to assembly modules as well. FIGS. 16, 17, and 17A provide various perspective views of three 5×2 assembly modules in various stages of connection with a header connector 24. As noted above the standard header connector module 24 pictured has a 5×6 dimension. Thus, the header module 24 can accept three 5×2 assembly modules.

Figure 18:
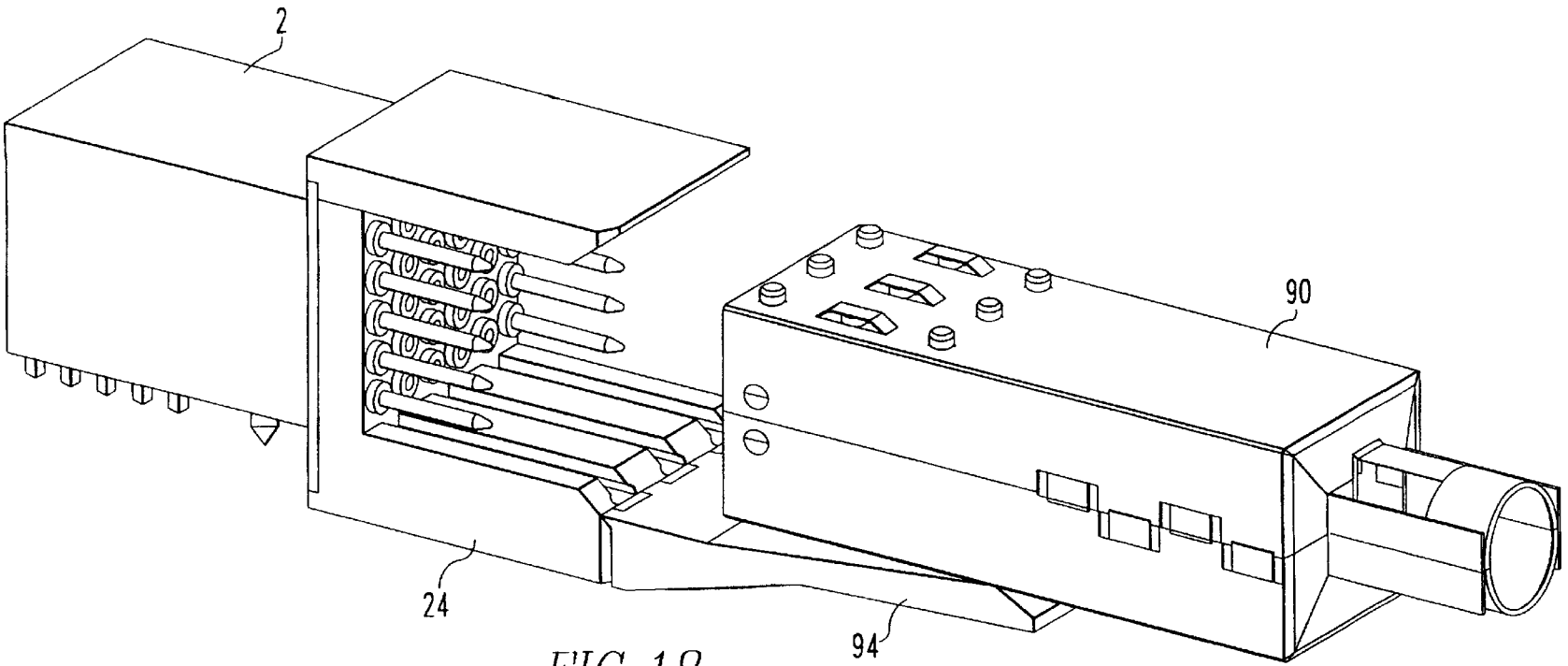
FIG. 18 provides a view of a 5×6 assembly module partially inserted into a header connector.
Figure 19:
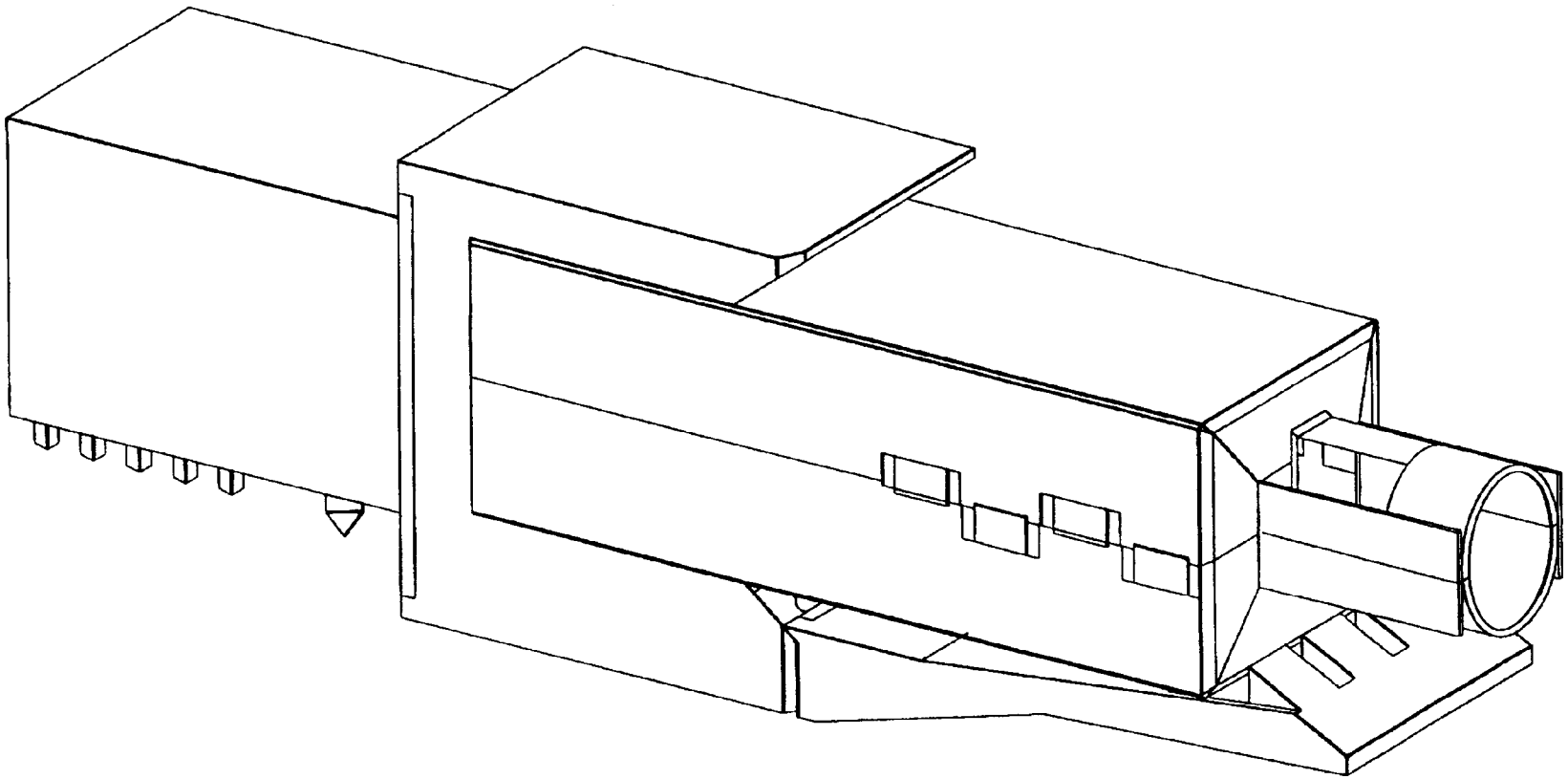
FIG. 19 provides a view of the 5×6 assembly module of FIG. 18 fully inserted into a header connector.

FIGS. 18 and 19 provide a similar view of a single 5×6 assembly module inserted in various stages of engagement with a standard sized 5×6 header module. In contrast with the 5×2 modules illustrated in FIGS. 16 and 17, the single 5×6 assembly module fills the 5×6 header. Thus, a header module of the present invention may receive assembly modules of varying sizes.

The invention as set forth above is likewise described in U.S. Provisional Patent Application No. 60/019168, filed Jun. 5, 1996 and titled "Shielded Cable Connector", which is hereby incorporated by reference.

The present invention may be employed in other specific forms without departing from the spirit or essential attributes thereof. For example, any number of materials may be used in manufacturing the shielding housing. Likewise different means for securing the shielding housing to the assembly modules might be used. While the invention has been described and illustrated with reference to specific embodiments, those skilled in the art will recognize that modification and variations may be made without departing from the principles of the invention as described hereinabove and set forth in the following claims.

What is claimed is:

1. A shielded cable interconnection for reducing EMI and crosstalk comprising:

an assembly module having a front end and a rear end, said front end containing front receptacle contacts and said rear end adapted to be attached to a cable, said assembly module having a constant width from said front end to said rear end;

a header connector adapted for accepting said assembly module;

EMI shielding forming an outer housing of said shielded cable interconnection and enveloping said assembly module and spanning from said front end to said rear end of said assembly module and completely enveloping said front receptacle contacts, said shielded interconnection outer housing comprising generally rectangular surfaces; and a latch member for securing said shielding housing and said assembly module to said header connector, said latch positioned to allow multiple assembly modules to be positioned in said header in close contact with each other.

2. The shielded cable interconnection of claim 1, wherein said header connector includes a side wall and said latch member is mounted on said side wall.

3. The shielded cable interconnection of claim 1, wherein said latch member comprises a leg end and a spring end.

4. The shielded cable interconnection as recited in claim 1, wherein said header connector comprises:

a first sidewall;

a second sidewall;

a rear header wall having multiple terminals extending therefrom for receiving said assembly module;

wherein said first sidewall and said second sidewall have at least three receiving slots for guiding said shielding housing into said shielded header connector;

said first sidewall and said second sidewall each further comprising at least two grounding springs;

said second header sidewall having a recess located therein for accepting said latch member.

5. The shielded cable interconnection as recited in claim 1 wherein said shielded header connector comprises:

a means for guiding said assembly module into said shielded header connector;

a means for grounding said shielding housing when inserted into said header connector;

a means for accepting said connecting latch for holding said shielding housing to said shielded header connector.

6. The shielded cable interconnection as recited in claim 5, wherein said shielding housing comprises two opposite exterior surfaces having at least one dimple recess formed on each of said opposite exterior surfaces, wherein said means for guiding said assembly module into said shielded header connector comprises:

receiving slots located in a first sidewall and a second sidewall, said slots accepting said at least one dimple recesses when the shielding housing is inserted into said shielded header connector.

7. The shielded cable interconnection as recited in claim 5, wherein said shielding housing comprises two opposite exterior surfaces having at least one dimple recess formed on each of said opposite exterior surfaces, wherein said means for grounding said assembly module into said shielded header connector comprises:

at least two grounding springs connected to a first sidewall and a second sidewall, said at least two grounding springs contacting said at least one dimple recess when said assembly module is inserted into said header connector.

8. The shielded cable interconnection as recited in claim 5 wherein said means for accepting said connecting latch for holding said shielding housing to said header connector comprises:

a receptacle located in a sidewall whereby one end of said latch connector is inserted into said receptacle and a second end of said connecting latch is attached to said shielding housing.

9. The shielded cable interconnection as recited in claim 1 wherein said header connector is electrically shielded.

10. The shielded cable interconnection as recited in claim 1 wherein said shielding housing is formed from electrically conductive material.

11. The shielded cable interconnection as recited in claim 10 wherein said shielding housing is formed from metal.

12. The shielded cable interconnection as recited in claim 1 wherein said shielding housing comprises:

a first half shell for enveloping a portion of said assembly module;

a second half shell for enveloping another portion of said assembly module; and means for attaching said first half shell with said second half shell so as to form shielding around the perimeter of said assembly module.

13. The shielded cable interconnection as recited in claim 12 wherein said means for attaching said first half shell with said second half shell comprises:

at least one latch extending from either said first half shell or said second half shell, wherein said latch comprises a detent member located on a tab; and at least one relief slot located in either said first half shell or said second half shell for accepting said at least one latch.

14. The shielded cable interconnection as recited in claim 13, wherein said relief slot comprises a flat lug displaced from a surface of said shielding housing.

15. The shielded cable interconnection as recited in claim 13, said assembly module having at least one stud extended from a side surface, said first half shell and said second half shell comprising:

at least one side recess through which said at least one stud extends from a side surface of said assembly module so as to insure that said assembly module is properly located within said first half shell and said second half shell.

16. The shielded cable interconnection as recited in claim 12, said shielded header connector having at least one slot located in a first sidewall and a second sidewall, said shielded header connector further having at least one grounding spring located on said first sidewall and said second sidewall, said assembly module having a stud extending from a lateral surface, wherein said first half shell and said second half shell comprise:

at least one raised dimple recess located on an opposing exterior wall of said first half shell and said second half shell, where said at least one raised dimple recess cooperates with said at least one slot in said header connector when inserted into said header connector so as to facilitate entry of said shielding housing into said shielded header connector, and where said at least one raised dimple recess contacts said at least one grounding spring located on said first sidewall and said second sidewall so as to provide adequate grounding to said shielding housing;

at least one lateral recess located on a lateral surface of said first half shell and said second half shell, where said at least one lateral recess receives said lateral stud extending from said assembly module so as to secure said first half shell and said second half shell around said assembly module.

17. The shielded cable interconnection as recited in claim 1 wherein said latch member comprises:

an elongated distal object having at least one first leg end for insertion into said header connector, and a second spring arm end located remotely away from said first end for connecting to said housing, so as to immobilize the relative movement of said shielded header and said housing and prevent inadvertent disconnection of said shielding housing from said header connector.

18. A shielded cable connector comprising:

an assembly module having an insulative body and a row of contact terminals received in the front of the body, the contact terminals being adapted to mate with an intermating contact terminal and receive a wire from a cable, and EMI shielding forming an outer housing of said shielded cable interconnect comprising:

a first half shell enveloping a first portion of said assembly module;

a second half shell enveloping the remaining portion of said assembly module; and means for attaching said first half shell with said second half shell so as to form shielding around the entire surface of said assembly module, including said front of the body, said shielded interconnection outer housing comprises generally rectangular surfaces such that multiple assembly modules can be placed in close contact with each other.

19. The shielded cable connector as recited in claim 18, wherein said means for attaching said first half shell with said second half comprises:

at least one latch extending from either said first half shell or said second half shell, wherein said latch comprises a detent member located on a tab; and at least one relief slot located in the other of said first half shell or said second half shell for accepting said at least one latch.

20. The shielded cable connector as recited in claim 19, wherein said relief slot comprises a flat lug displaced from a surface of said shielding housing.

21. The shielded cable connector as recited in claim 20, said assembly module having at least one stud extended from a side surface, said first half shell and said second half shell comprising:

at least one side recess through which said at least one stud extends from a side surface of said assembly module so as to insure that said assembly module is properly located within said first half shell and said second half shell.

22. A shielded cable interconnection for reducing EMI and crosstalk comprising:

a plurality of individual assembly modules each adapted to be attached to a cable and having a plurality of outer surfaces;

a header connector adapted for accepting said plurality of individual assembly modules in a stacked manner, said header connector further comprising guide slots for guiding said assembly modules into close stacked proximity with each other;

an EMI shielding housing for enveloping said plurality of outer surfaces of each of said individual assembly modules and having protrusions on two of its outer surfaces for interacting with said guide slots for guiding said assembly modules into close stacked proximity with each other and having two of its other outer surfaces without protrusions in close stacked proximity; and a latch member for securing said shielding housing and said assembly module to said header connector, said latch positioned positioned to allow multiple assembly modules to be positioned in said header in close contact with each other.

* * * * *